US006018934A

United States Patent [19]

Parcels

[11] Patent Number: 6,018,934

[45] Date of Patent: Feb. 1, 2000

[54] METHOD AND APPARATUS FOR ATTACHING CORNER PROTECTORS TO PICTURE FRAMES

[76] Inventor: Joseph S. Parcels, 5537 Crest De Ville, Orange, Calif. 92687

[21] Appl. No.: 09/080,668

[22] Filed: May 14, 1998

[51] Int. Cl.[7] ..... B65B 23/00

[52] U.S. Cl. ..... 53/472; 53/139.7; 53/410; 53/462

[58] Field of Search ..... 493/383, 384, 493/385, 386, 389, 952; 53/139.5, 139.6, 139.7, 462, 207, 397, 410, 580; 206/586

[56] References Cited

U.S. PATENT DOCUMENTS

| | | | |
|---|---|---|---|
| 2,226,601 | 12/1940 | Euller | 206/60 |
| 3,725,170 | 4/1973 | Doll | 156/217 |
| 4,598,825 | 7/1986 | Wiley et al. | 206/586 |
| 4,757,666 | 7/1988 | Janhonen | 53/176 |

*Primary Examiner*—Joseph J. Hail, III
*Attorney, Agent, or Firm*—William L. Chapin

[57] ABSTRACT

A method and apparatus for installing covers to protect picture frame corners from damage during shipment utilizes thin cardboard preforms having symmetric, left and right-side, right-triangular cover flaps joined at vertical sides thereof to opposite vertical sides of a vertically elongated, rectangular spine flap, the left-hand triangular cover flap having depending downwardly from its base a horizontally elongated rectangular side cover flap, and depending downwardly from the lower lateral edge of the side cover flap a trapezoidally-shaped securement flap. The preform is positioned below a picture frame corner, with intersecting side members of the frame vertically aligned with the sides of the left-hand right-triangular cover flap, which serves as a lower face cover flap. The apparatus includes folder mechanisms including flap folder arms which fit into worktable recesses, and which bend the side cover flap and securement flap into a vertical position adjacent a first side of the frame corner and perpendicularly inwardly to overlie the first frame member, bend the spine flap and right-hand triangular cover flap into a vertical position adjacent the second frame member, and the right-hand triangular flap perpendicularly inwards from the spine flap to overlie the second and first frame members. An automatic staple gun then inserts a staple downwardly through the right-triangular cover flap into the securement flap and left-hand frame member, securing the corner protector in a folded disposition over the frame corner.

23 Claims, 17 Drawing Sheets

METHOD AND APPARATUS FOR ATTACHING CORNER PROTECTORS TO PICTURE FRAMES

BACKGROUND OF THE INVENTION

A. Field of the Invention

The present invention relates to methods for protecting the corners of rectangularly-shaped picture frames from impact damage during shipping. More particularly, the invention relates to a method and apparatus for attaching protective covers to the corners of picture frames.

B. Description of Background Art

Picture frames for holding and displaying paintings, photographs, diplomas, certificates and similar flat articles are manufactured in prodigious quantities worldwide. Although picture frames vary in shape and construction details, most frames have a rectangular plan view shape. Moreover, the structure of most picture frames consists essentially of four straight channel members or moldings, each having an inner channel that intersects channels of adjacent members at a ninety degree angle. Four such channel members fastened together form a rectangular ring-shaped frame. The channels or recesses in the moldings comprise spaces for receiving a rectangularly-shaped flat display piece such as a photograph or painting, and sometimes, a backing panel, mat and protective cover glass.

Picture frames of the type described above are made from a variety of materials including, wood, metal and plastic. Whatever material the frame is made of, the geometry of a rectangular picture frame dictates that it have four peripheral members of generally uniform thickness and joined to each other at fourty-five degree mitre angles to form ninety degree corners. These corners protrude, and are therefore highly subject to breakage, denting or cosmetic damage during shipment. Accordingly, most picture frames, whether empty or occupied, are fitted with some sort of corner protectors during shipment. Such corner protectors are usually made of a relatively inexpensive recyclable material such as cardboard or polystyrene foam. Typical corner protectors of this type are disclosed in U.S. Pat. Nos. 3,955,677, 4,598,825, and 5,447,233. Other patents, related to protecting corners of objects during shipping include U.S. Pat. No. 4,407,898. Also, U.S. Pat. No. 5,255,458 discloses a three-dimensional picture corner and U.S. Pat. No. 4,787,553 discloses a corner fastening device.

In addition to the above-referenced patents related to corner protectors and the like, a variety of machines for bending sheet metal or cardboard of the type used for corner protectors have been disclosed in the following U.S. Pat. Nos.: 4,132,102, 4,585,432, 4,713,957, 4,857,038, 4,956,961, and 5,184,998. However, the present inventor is unaware of any machines for automatically attaching corner protectors to picture frames. The present invention was conceived to provide that capability.

OBJECTS OF THE INVENTION

An object of the present invention is to provide a method for attaching protective covers over the corners of a picture frame, to protect the corners from damage during transit.

Another object of the invention is to provide an apparatus for automatically attaching protective covers over the corners of picture frames.

Another object of the invention is to provide an apparatus for folding a flat sheet of flexible material over the corner of a picture frame and securing folds of the material together to form a protective cover for the corner of the picture frame.

Another object of the invention is to provide an apparatus for bending a flat cardboard preform cut to a pre-determined shape over the corner of a picture frame, and securing the folded portions of the cardboard preform to each other and to the picture frame to form a corner protector for the picture frame.

Another object of the invention is to provide a picture frame corner protector attaching apparatus which includes means for clamping and holding the corner of a frame, folding a preform sheet having the shape of a truncated isosceles triangle with a trapezoidally-shaped tab depending downward from one side of the base of the triangle into three separate flaps which overlap the corner of the frame, and stapling the flaps together and to the frame to form a corner protector therefor.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention contemplates a method and apparatus for installing protective cardboard covers over the corners of a picture frame, to protect the corners from damage during shipment.

The picture frame corner protector installation method and apparatus according to the present invention utilizes corner protectors made from thin sheets of cardboard, each pre-cut, by die cutting, for example, into a generally triangular shape which is modified to adapt the preform to be folded over and enclose a corner and adjacent portions of the side channel members of a conventional rectangularly-shaped picture frame. Four such corner protectors are used to cover the four corners of the frame. In the preferred embodiment of the invention the overall plan view shape of the corner protector preform is that of two mirror symmetric, left and right, right-triangularly shaped flaps having collinear horizontal bases joined to opposite vertical sides of a vertically elongated rectangular spine flap. Thus shaped, the preform has the appearance of an isosceles triangle whose vertex is horizontally truncated. The preform preferably includes a horizontally elongated rectangularly shaped lower cover flap which depends downwardly from the base of one of the right-triangle flaps, the left one, for example, and has the same width as the left triangular cover flap. A trapezoidally-shaped securement flap depends downwardly from the bottom edge of the lower cover flap, the securement flap having a lower edge wall parallel to but shorter than that of the lower cover flap. In the preferred embodiment, the horizontal width of the vertically elongated rectangular spine flap and the vertical height of the horizontally elongated lower cover flap have a common value which is slightly greater than the thickness of a picture frame which is to be protected, e.g., about 15/16 inch for a frame thickness of 5/8 inch. Preferably, the vertical side walls of the vertical spine flap and the horizontally disposed upper and lower edges of the lower cover flap are scored to facilitate folding those respective strips to contact adjacent perpendicular channel members or moldings of a picture frame.

According to the method of the present invention, a pre-form, score lines up, is positioned below the corner of a picture frame, with a pair of perpendicularly intersecting adjacent side walls defining a corner of the frame vertically aligned with the perpendicular sides of the left-hand right-triangular flap having the downwardly depending lower cover and securement flaps. The lower cover and securement flaps are then folded vertically upwards as a planar unit along the upper or inner score line defining the junction between the base of the left right-triangular cover flap and the lower cover flap. Next, the securement flap is folded downwardly and inwardly along the lower or outer score line towards a horizontal position contacting the upper surface of the frame member overlying the left triangularly-shaped cover flap. Then, the second, right-hand, right-triangularly-shaped cover flap and spine flap are bent upwards as a unit along the innermost vertical fold line, i.e., the left-hand vertical edge of the spine flap, to a vertical position. The right-hand triangular cover flap is then bent downwards and inwards along the outermost, right-hand vertical fold line of the spine flap to a horizontal position overlying and contacting the securement flap. Finally, the overlying right-hand triangular cover flap is fastened to the securement flap, by stapling, for example. In the preferred embodiment of the invention, using a wooden picture frame, a staple is driven through both the overlying right-hand triangular cover flap and the securement flap and into the underlying wooden frame member, thereby securing the corner protector to the frame.

With a preform attached to a corner of a picture frame as described above, the first, left-hand triangular cover flap covers a right triangular portion of the lower side of the frame corner, and the lower, rectangularly-shaped cover flap covers a portion of the outer, vertical side wall of a first side channel member of the frame, e.g., the "left-hand" side channel member. Also, the second, right-hand triangular cover flap covers a right triangular portion of the upper side of the frame cover overlying the lower triangular cover flap, while the spine flap covers a portion of the outer, vertical side wall of the second, "right-hand" side channel member.

The apparatus according to the present invention includes a base plate or work table having a flat upper surface for supporting a picture frame, and a frame holder clamping jig for receiving and holding a corner of the picture frame on the surface of the table. Also included in the apparatus is a pair of corner flap folder actuators positioned on opposite sides of the corner of a picture frame held in the clamping jig. Each corner folder actuator includes a flat, rectangularly-shaped flap-contacting arm mounted near a longitudinal end thereof on the upper end of a post which is actuatable by a linear actuator from a lower inactive position in which the arm resides within a rectangularly-shaped recess in the upper surface of the base plate, with the upper surface of the arm flush with the upper surface of the base plate, to an upper, active position. Each post also includes a 90-degree rotary actuator means, which is effective in rotating a flap contacting arm, when raised, from an outer position contacting the outer vertically disposed side of a flap to an inner position effective in exerting an inwardly and downwardly directed folding force on the flap.

In operation, the first corner folder actuator arm is extended vertically, folding the lower cover flap and securement flap upwardly into a vertical position adjacent one side of a frame. The arm is then rotated inwards, bending the securement flap inwardly and downwardly into contact with the upper surface of the first frame molding strip.

Next, the actuator arm of the second corner folder actuator is elevated, folding the upper triangular cover protector flap upwards to a position vertically adjacent the outer edge of the second frame molding strip. The arm of the first corner folder actuator is then rotated outwards from its position overlying and holding down the securement flap, while the arm of the second actuator is simultaneously rotated inwards, bending the triangular flap down into contact with the securement flap. An automatic stapling machine then inserts a staple through the upper triangular flap, underlying securement flap, and underlying frame molding, thereby securing the corner protector to the frame. Both actuator arms are then automatically rotated and retracted to their recessed positions, flush with the work table surface. At the same time, the frame holding clamp is also automatically released, allowing the frame with attached corner protector to be removed from the clamp. The frame may then be rotated ninety degrees, and reinserted into the clamp, allowing each of three remaining corners of the frame to in turn have a corner protector attached thereto in the manner described above.

DESCRIPTION OF THE PREFERRED EMBODIMENTS

FIGS. 1–24 depict an apparatus for attaching corner protectors to picture frames according to the present invention.

Figure 1:
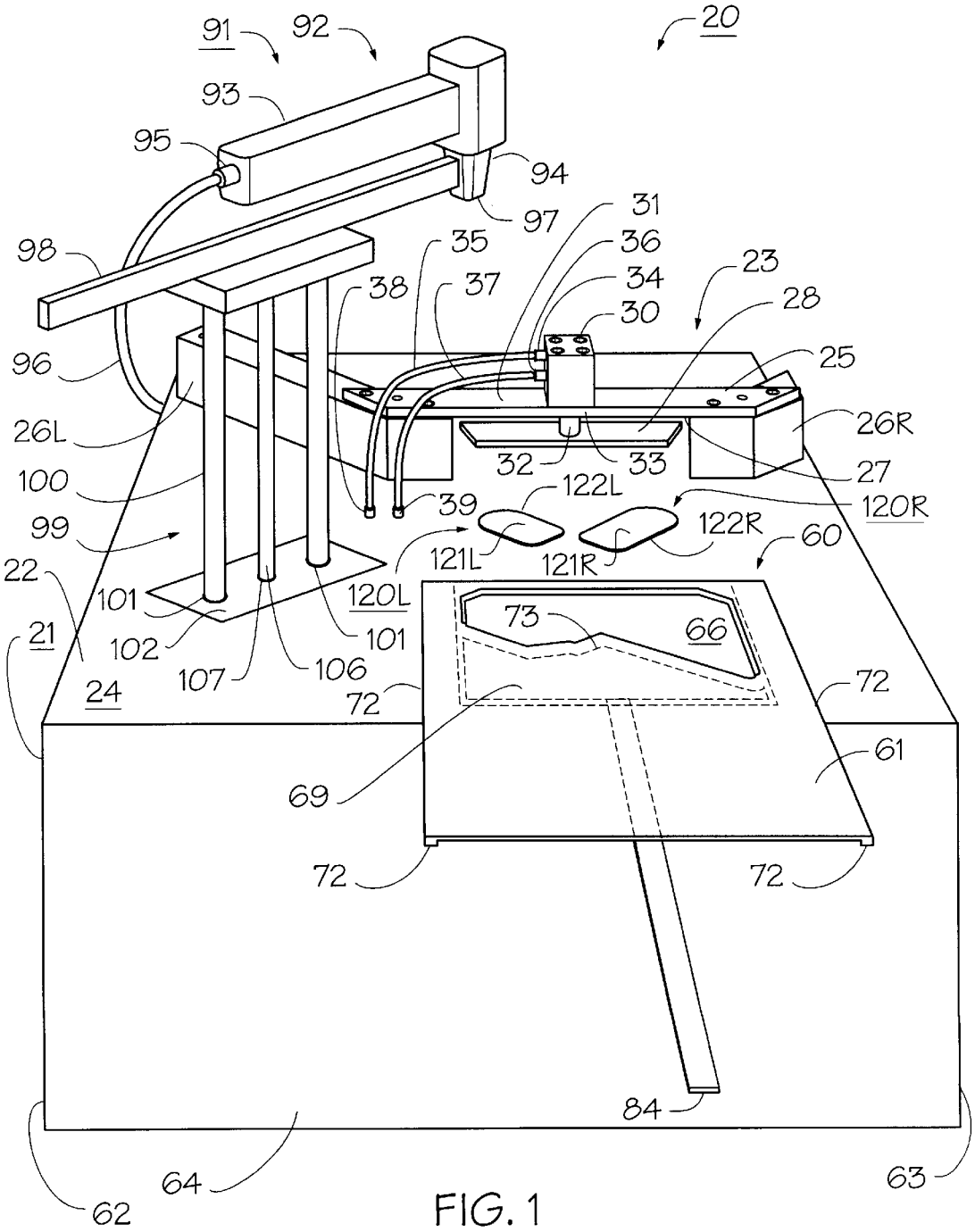
FIG. 1 is an upper perspective view of a corner protector attachment apparatus according to the present invention.
Figure 2:
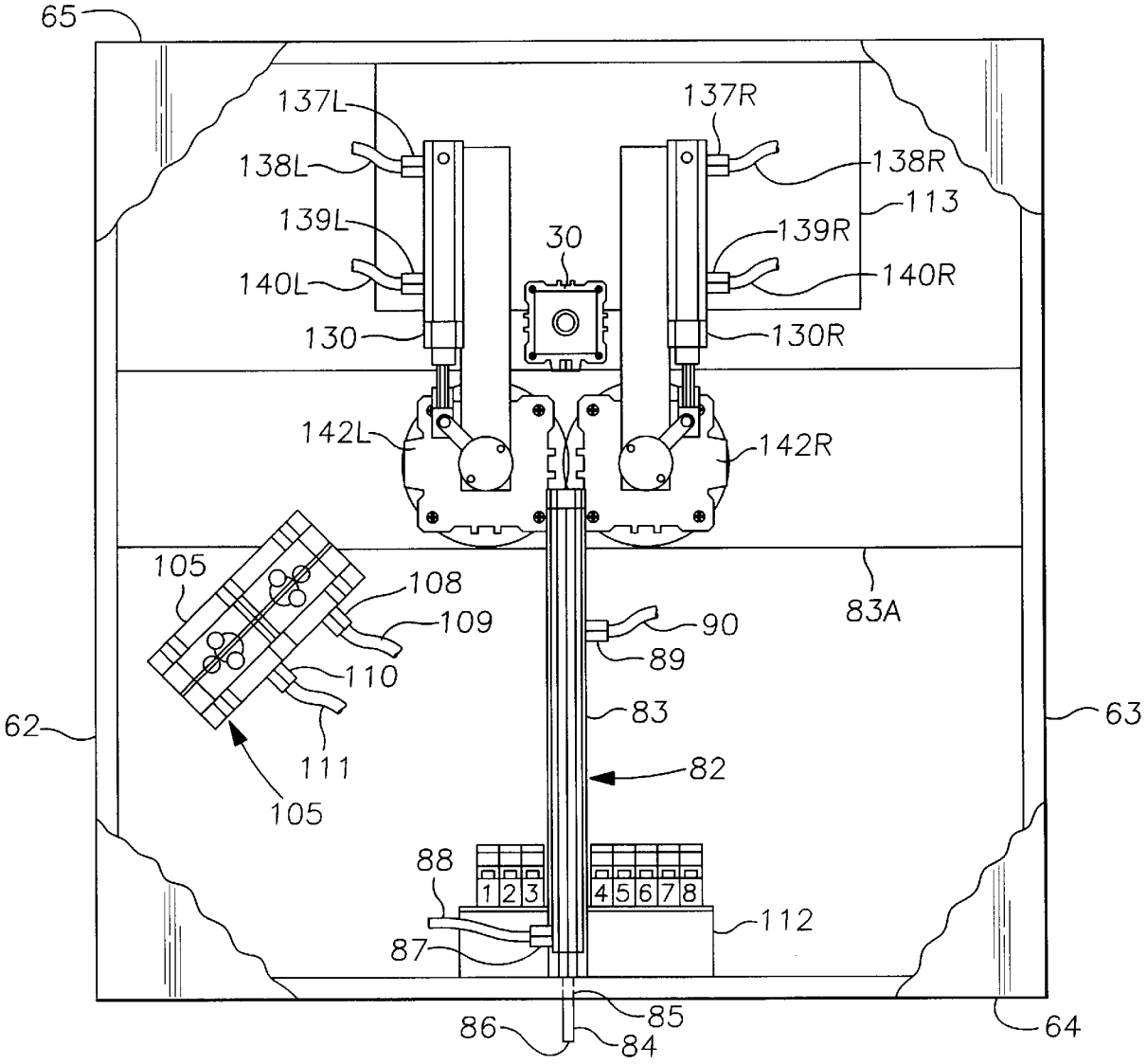
FIG. 2 is a fragmentary upper plan view of the apparatus of FIG. 1, showing an upper work table or cover plate thereof removed to reveal underlying mechanical components of the apparatus.
Figure 6:
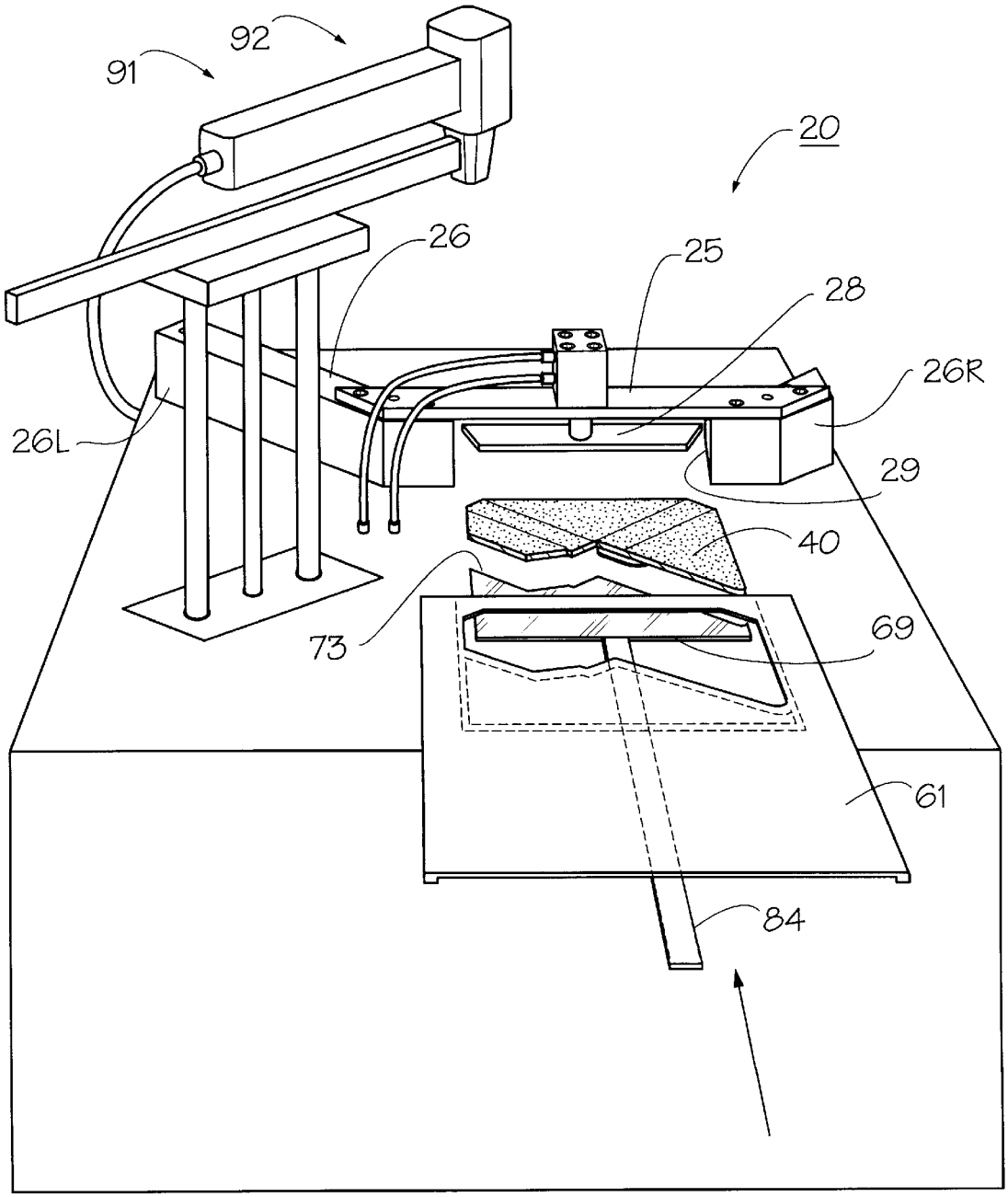
FIG. 6 is a view similar to that of FIG. 5, but showing a single corner protector preform advanced into clamping position.

Referring now to FIGS. 1 and 2, an apparatus 20 for attaching corner protectors to picture frames according to the present invention may be seen to include a generally rectangular box-shaped enclosure 21 surmounted by a generally flat, upper base plate or work table 22. As may be seen best by referring to FIG. 1, apparatus 20 includes an elongated, generally straight frame holding/clamping jig 23 mounted on the upper surface 24 of work table 22, near rear wall 65 of enclosure 21. Preferably, clamping jig 23 is disposed obliquely with respect to the rectangular plan-view shape of work table 22. As shown in FIGS. 1 and 6, clamping jig 23 is spaced above upper surface 24 of table 22, and includes an elongated upper straight beam member 25, supported at opposite lateral ends thereof by a pair of laterally opposed, left and right support blocks 26L and 26R, respectively. Support blocks 26 have flat and parallel lower and upper surfaces, 226 and 227, respectively, the latter supporting clamp beam member 25 so that its lower surface 27 is parallel to and spaced above upper surface 24 of work table 22.

Figure 20:
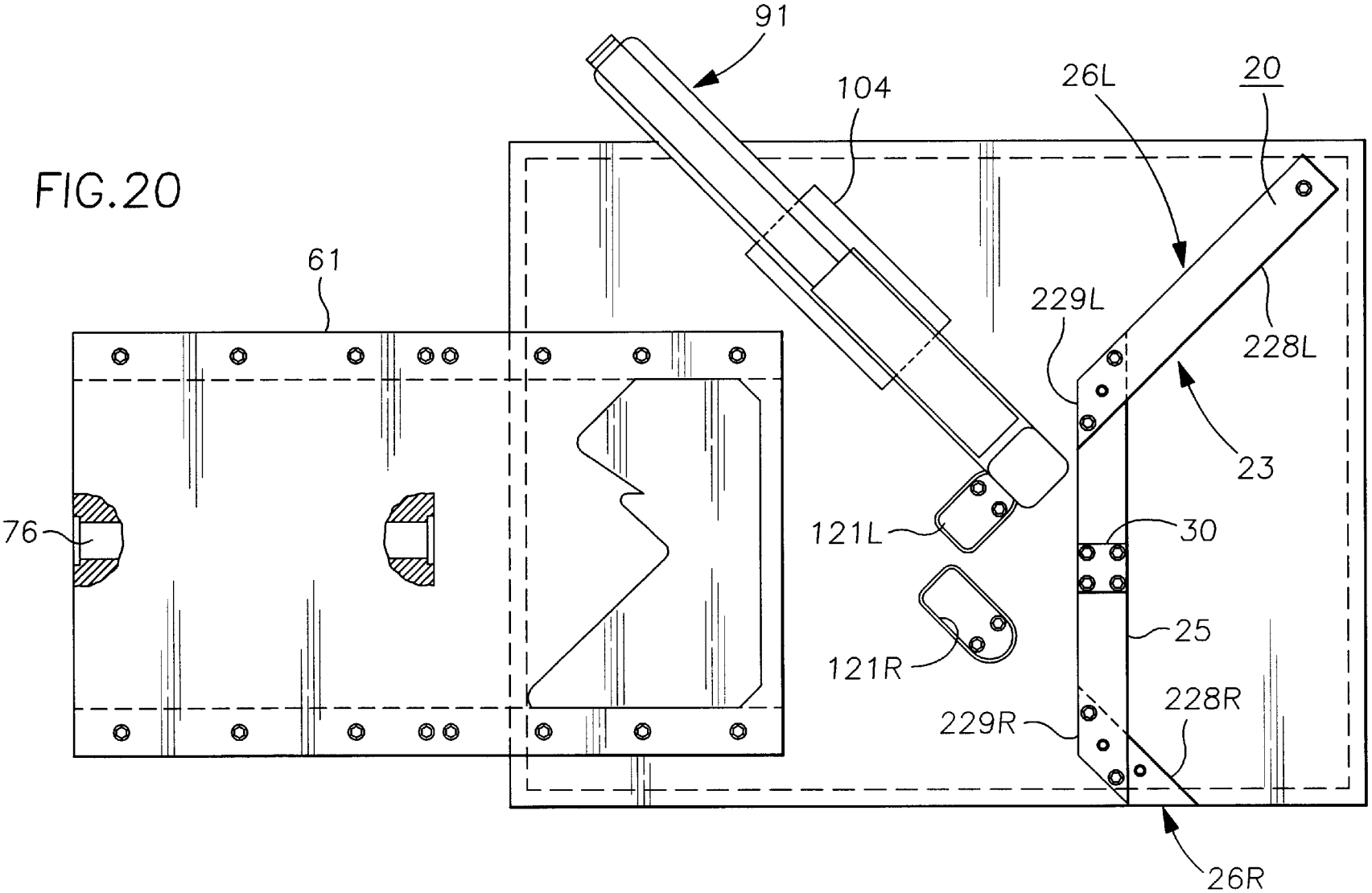
FIG. 20 is an upper plan view of the apparatus of FIG. 17.
Figure 21:
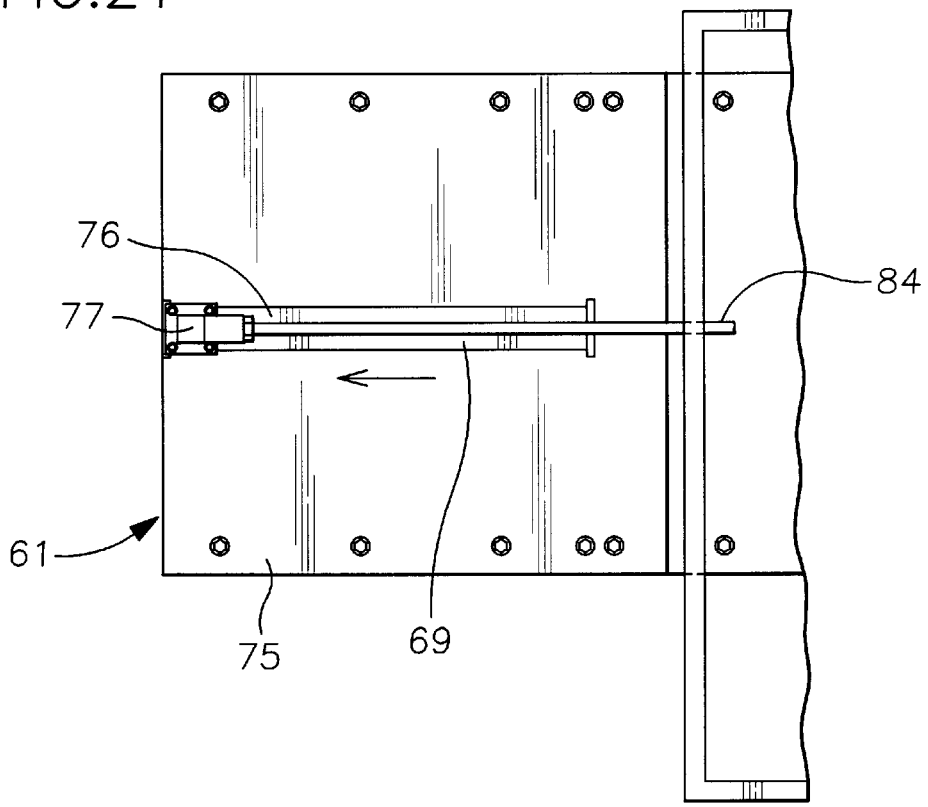
FIG. 21 is a lower plan view of the apparatus of FIG. 17, showing a pusher plate thereof in a retracted, home position.
Figure 22:
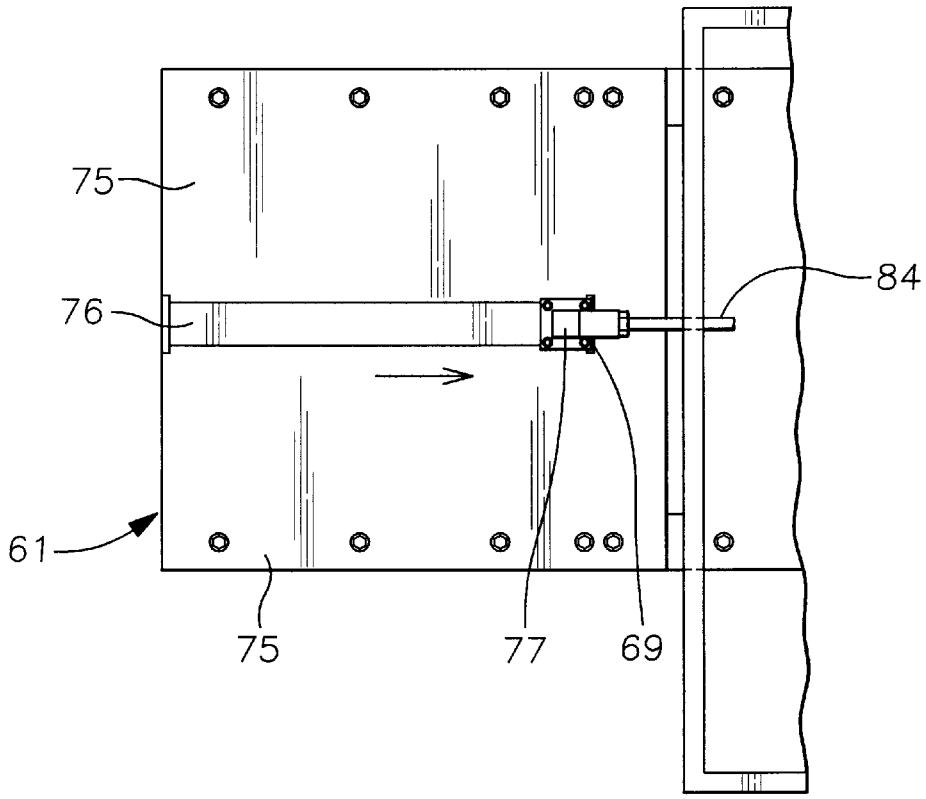
FIG. 22 is a view similar to that of FIG. 21, showing the pusher plate thereof in a forward, feed position.
Figure 23:
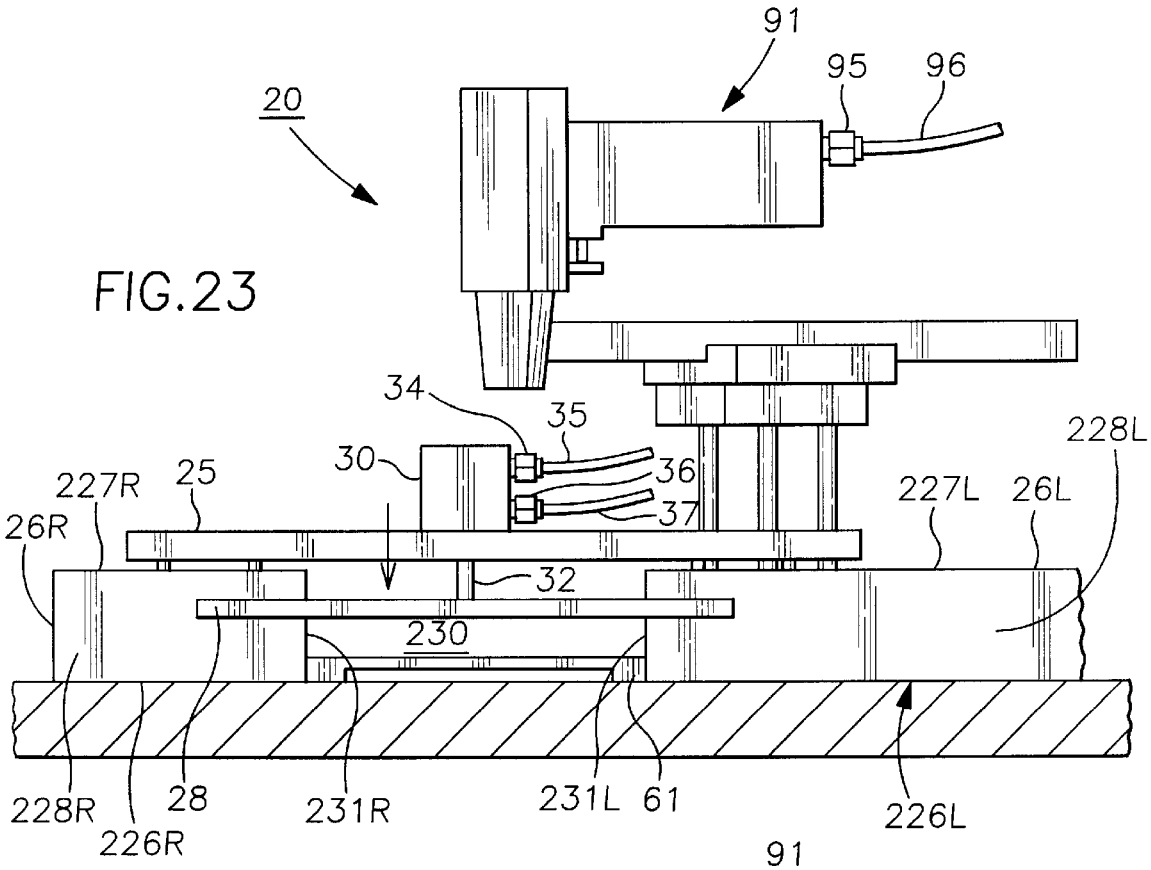
FIG. 23 is a rear elevation view of the apparatus of FIG. 1, showing a clamp bar thereof in an upper, inactive position.
Figure 24:
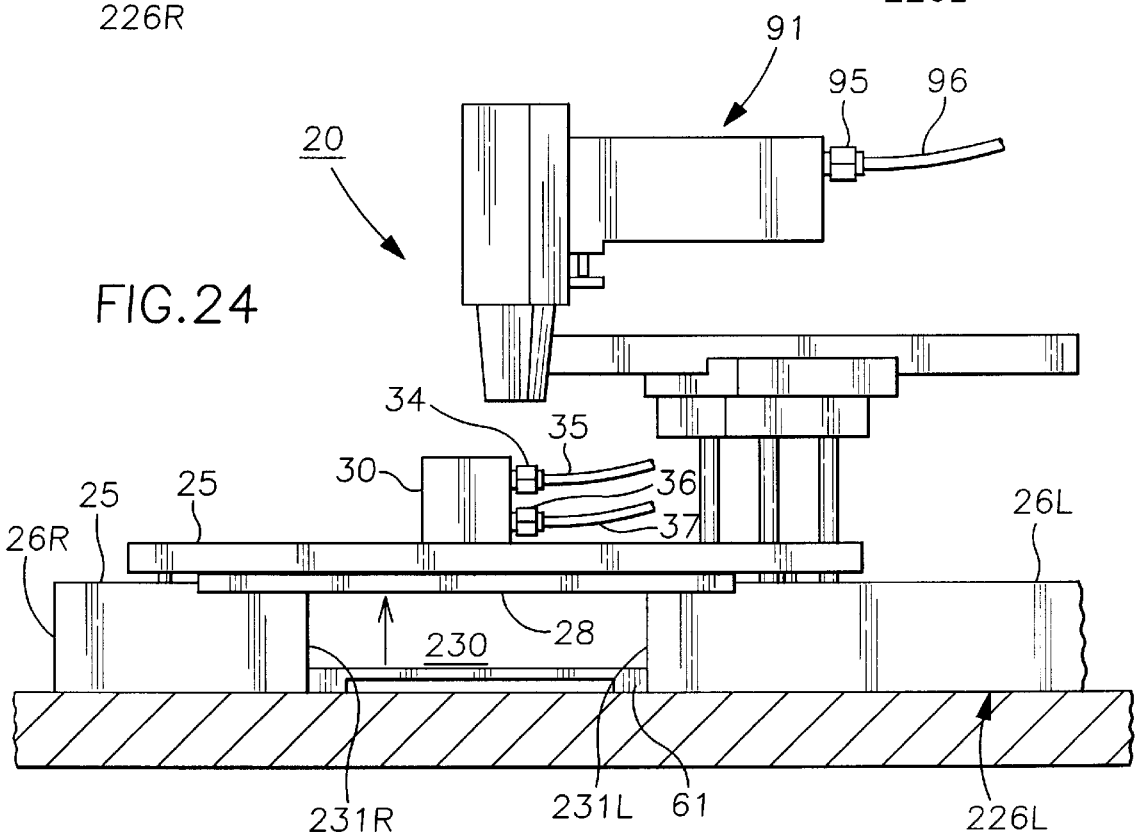
FIG. 24 is a view similar to that of FIG. 23, showing the clamp bar thereof in a lower, clamping position.

As shown in FIGS. 20, 23 and 24, left and right support blocks 26L and 26R have inner longitudinally disposed vertical wall surfaces 228L and 228R, respectively. If extended forward, inner vertical surfaces 228L and 228R of support block 26L and 26R would intersect to form a right angle corner. However, as shown in FIGS. 1 and 20, support blocks 26L and 26R are provided with obliquely disposed front face walls 229L and 229R, respectively, that are coplanar, and angled at 45 degrees to inner vertical side walls 228L and 228R. Thus arranged, inner vertical side walls 228L and 228R form guide walls along which may be slid the outer side walls of side channel members of a rectangular picture frame that intersect each other at a ninety-degree corner. A laterally disposed space 230 between opposed inner corners 231L and 231R of support blocks 26L and 26R allows the corner of a picture frame to protrude forward beyond front faces walls 229L and 29R of the guide blocks.

As may be seen best by referring to FIGS. 1, 2, 6 and 7, clamping jig 23 includes a horizontally disposed, elongated straight clamp bar 28 located below and in vertical alignment with clamp beam member 25. Clamp bar 28 is vertically movably held with respect to clamp beam member 25. Thus, as shown in FIGS. 1 and 6, clamping jig 23 includes a linear actuator comprising a double acting pneumatic cylinder 30, for raising and lowering clamp bar 28. Clamp bar cylinder 30 is mounted on the upper surface 31 of clamping jig support beam 25, and has a piston rod 32 which protrudes vertically downwards in a bore 33 provided through the thickness dimension of the support beam. The lower end of piston rod 32 has a square transverse sectional shape which protrudes through a similarly shaped bore through clamp bar 28, and is secured to the clamp bar by a screw (not shown) 29. Since pneumatic cylinder 30 is of the type in which piston rod 32 is non-rotatable, clamp bar 28 is maintained in a fixed horizontal orientation when moved vertically with respect to work table 22.

Figure 7:
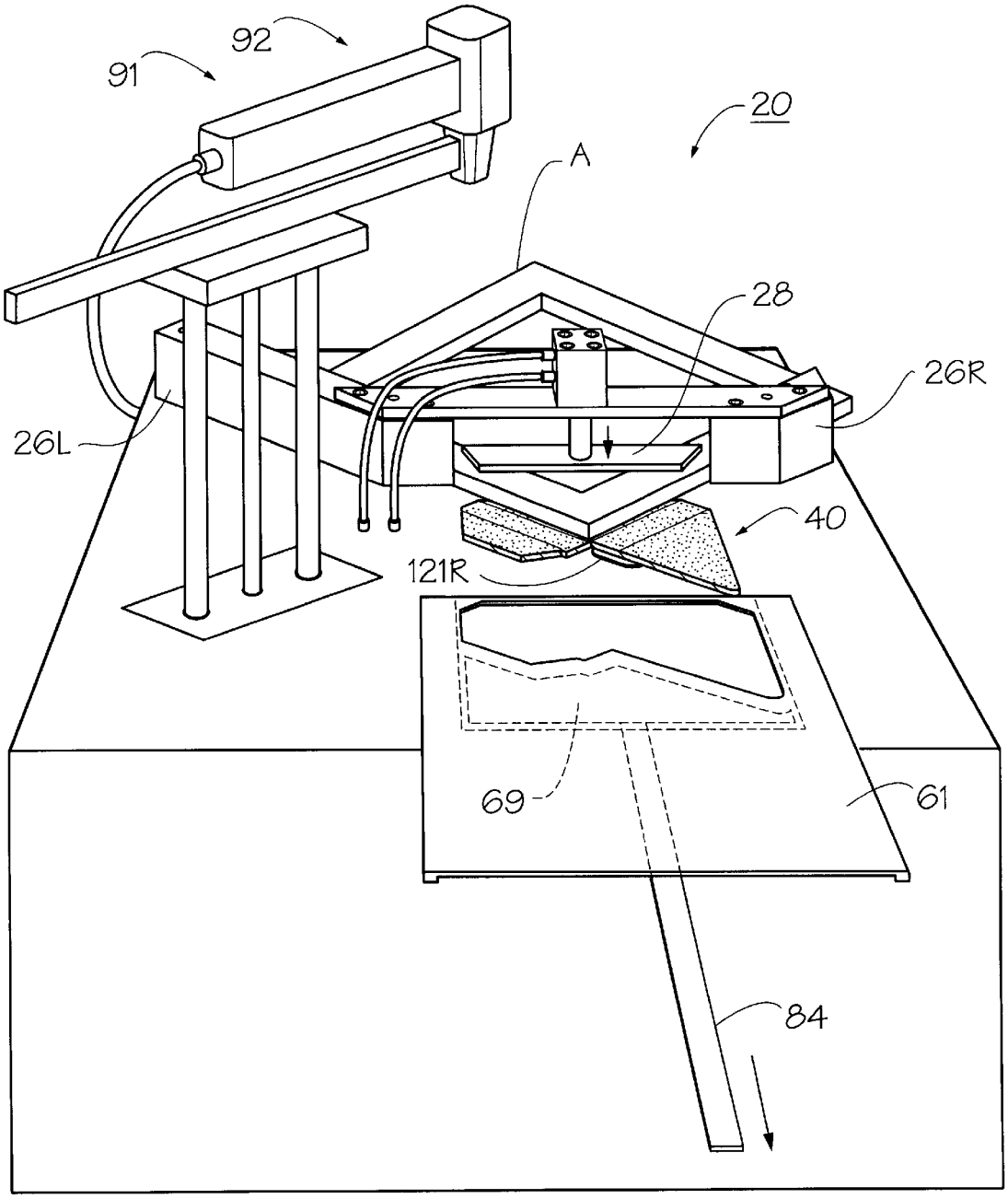
FIG. 7 is a view similar to that of FIG. 6, but showing a picture frame inserted into clamping jig comprising part of the apparatus, and above a corner protector blank, and showing a clamp bar of the clamping jig brought down into compressive contact with the upper surface of the frame.
Figure 8:
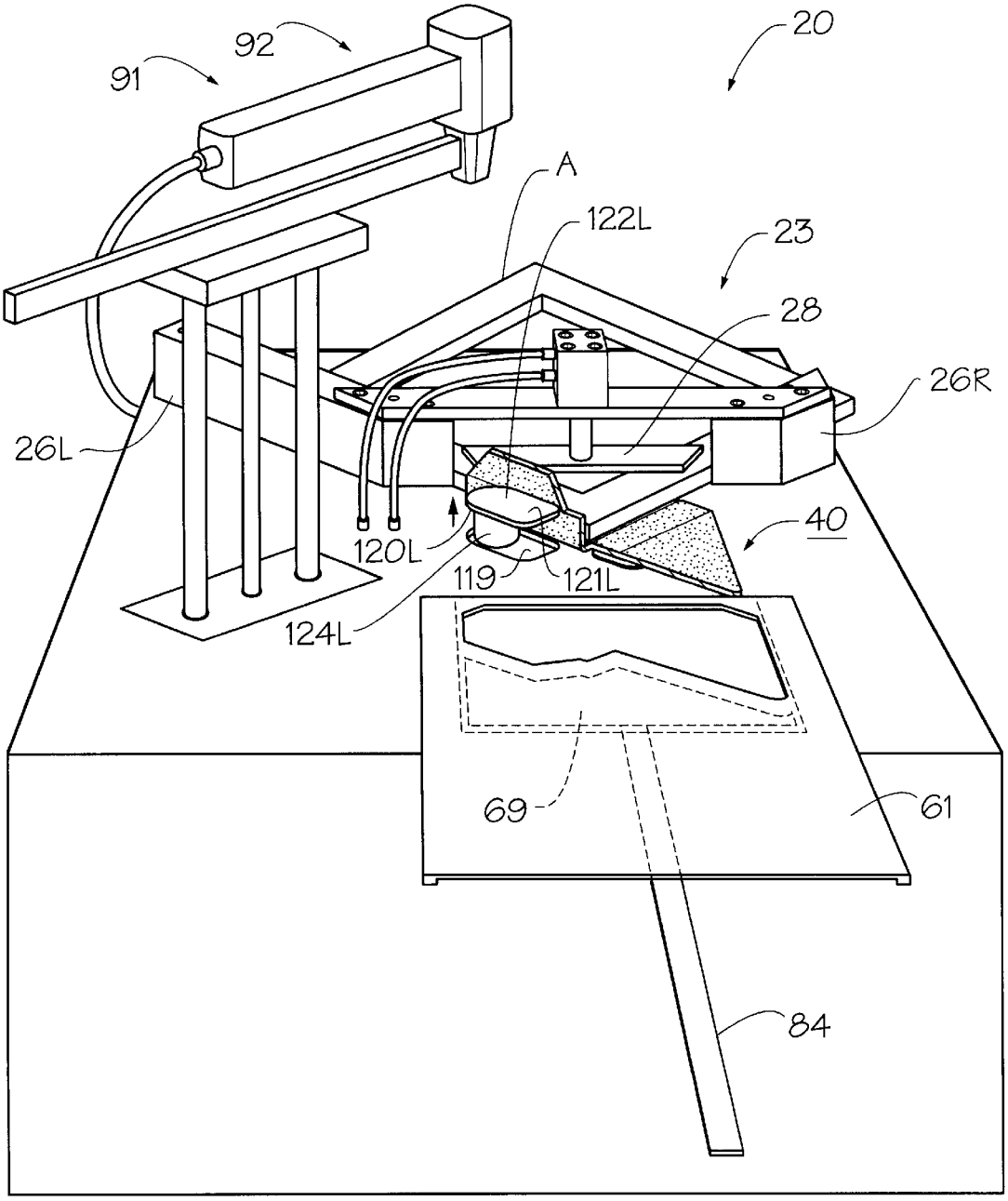
FIG. 8 is a view of the apparatus of FIG. 7, similar to that of FIG. 6, but showing a first corner flap actuator comprising part of the apparatus in an upwardly actuated position.
Figure 9:
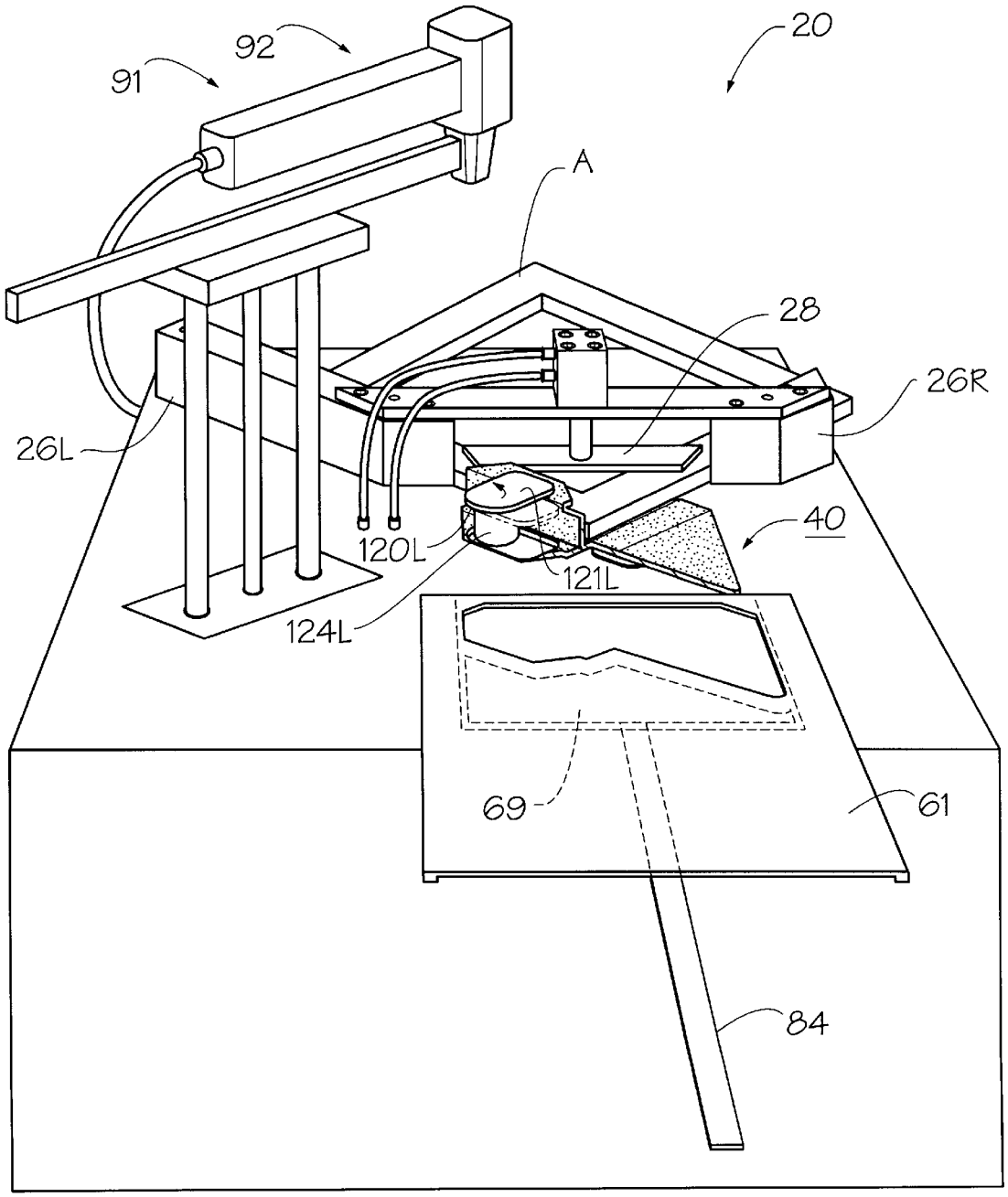
FIG. 9 is a view of the apparatus of FIG. 1 similar to that of FIG. 8, but showing a fold-effecting arm of the first corner flap actuator rotated to contact and fold down a securement flap of the corner protector preform into a position overlying the picture frame.
Figure 10:
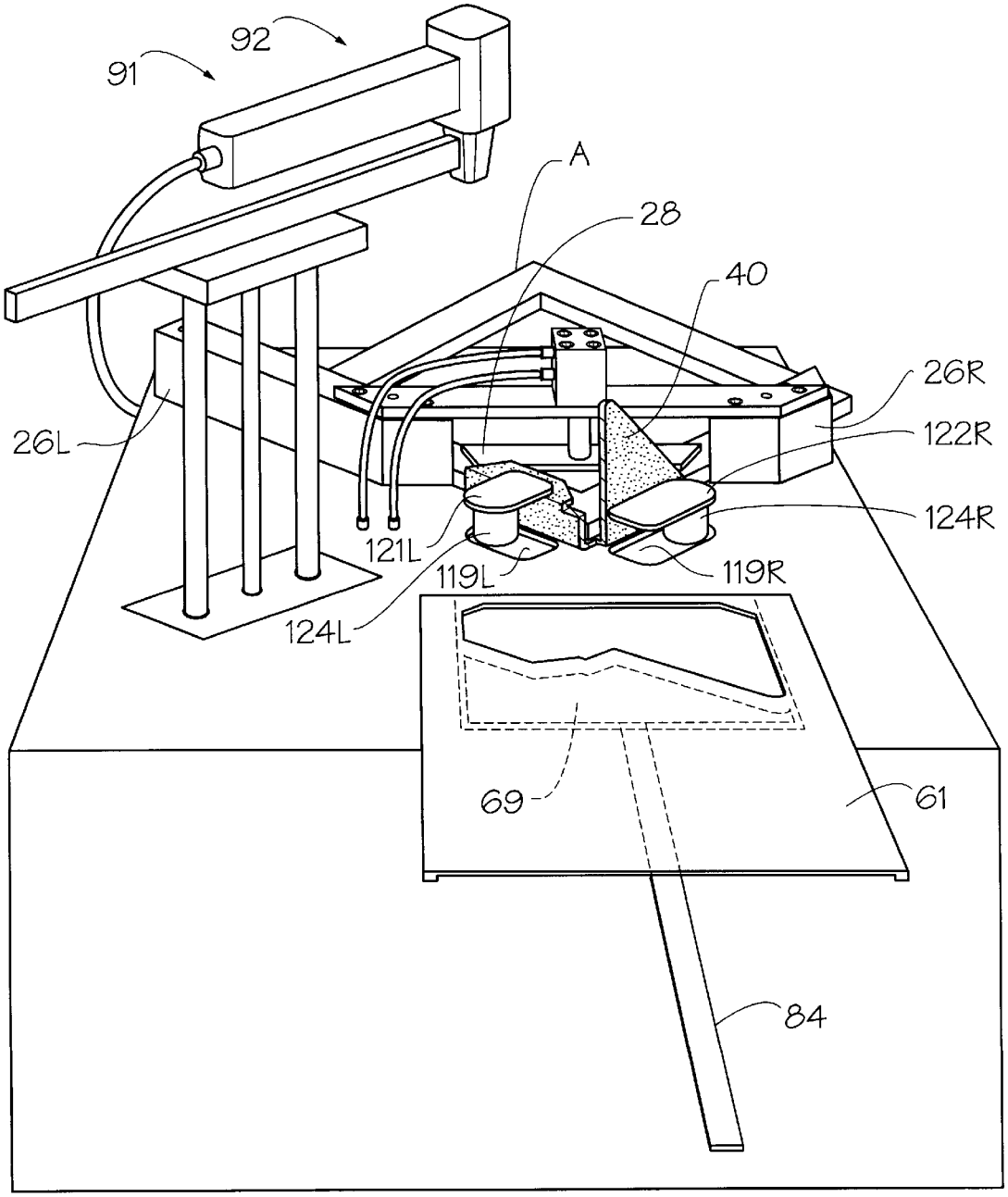
FIG. 10 is a view of the apparatus of FIG. 1 similar to that of FIG. 9, but showing a second corner flap actuator of the apparatus in an upwardly actuated position.
Figure 11:
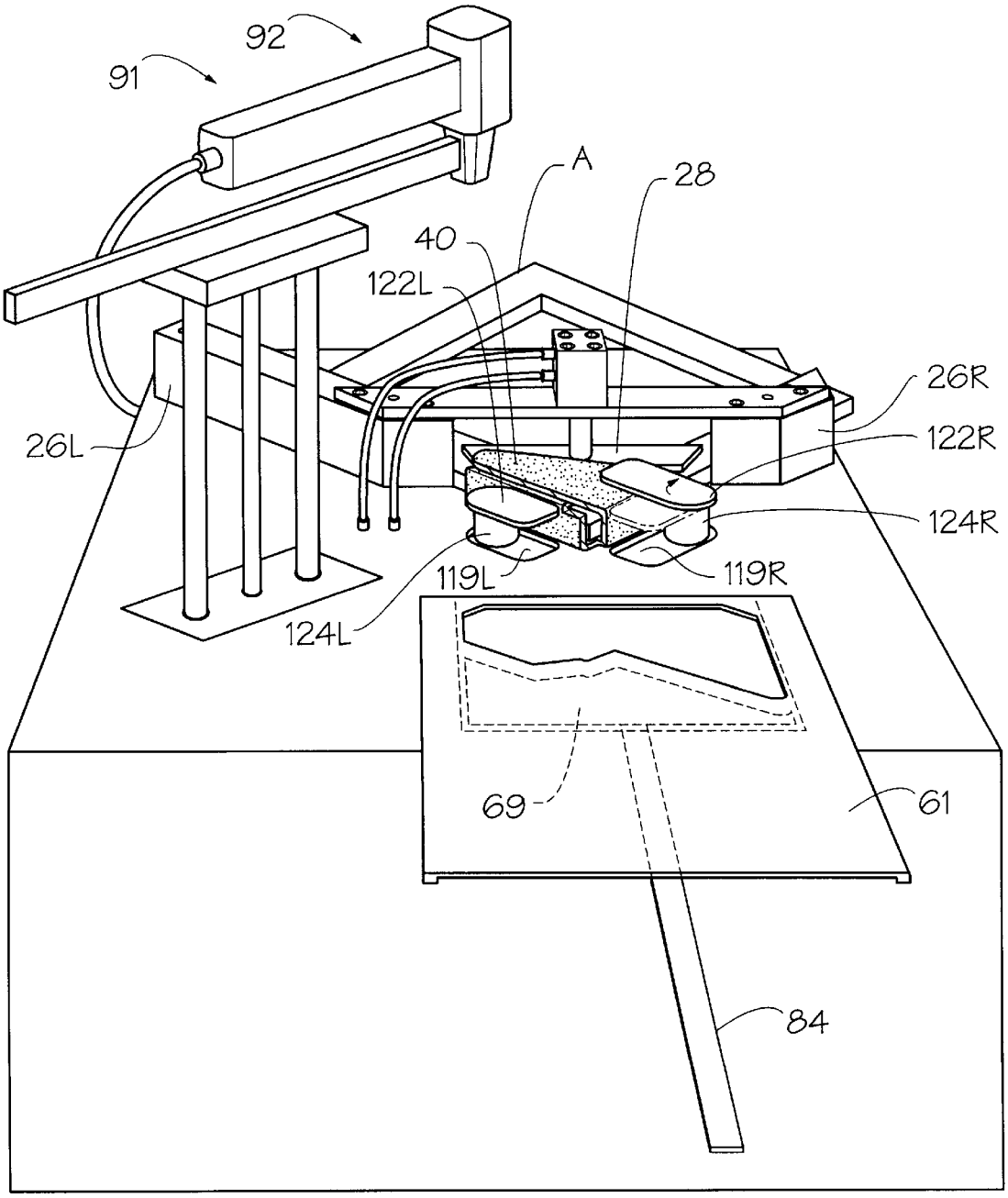
FIG. 11 is a view of the apparatus of FIG. 1 similar to that of FIG. 10, but showing a fold effecting arm of the second corner flap actuator rotated to contact and fold down a second triangular cover flap of the corner protector preform into a position overlying the securement flap of the corner protector preform.

As shown in FIG. 1, clamp bar cylinder 30 has an upper pressurized "down" air inlet port 34 connected to a first "down" air inlet hose 35, and a second, lower, "up" air inlet port 36 connected to a second, "up" air inlet hose 37. Hoses 35 and 37 connect to tubular fittings 38 and 39 which protrude downwards through upper surface 24 of work table 22, to control valves and a source of pressurized air, as will be discussed in detail below. When pressurized air is supplied to "up" inlet port 36 of clamp air cylinder 30, pressurized air on the lower side of a piston within the cylinder forces the piston, attached piston rod 32, and attached clamp bar 28 upwards to an upper, unlocked position, as shown in FIG. 1. Conversely, when pressurized air is supplied to "down" inlet port 34 of clamp air cylinder 30, pressurized air on the upper side of the piston within the cylinder forces the piston and clamp bar 28 downwards to a lower position in clamping contact with a picture frame A, as shown in FIG. 7.

Figure 4:
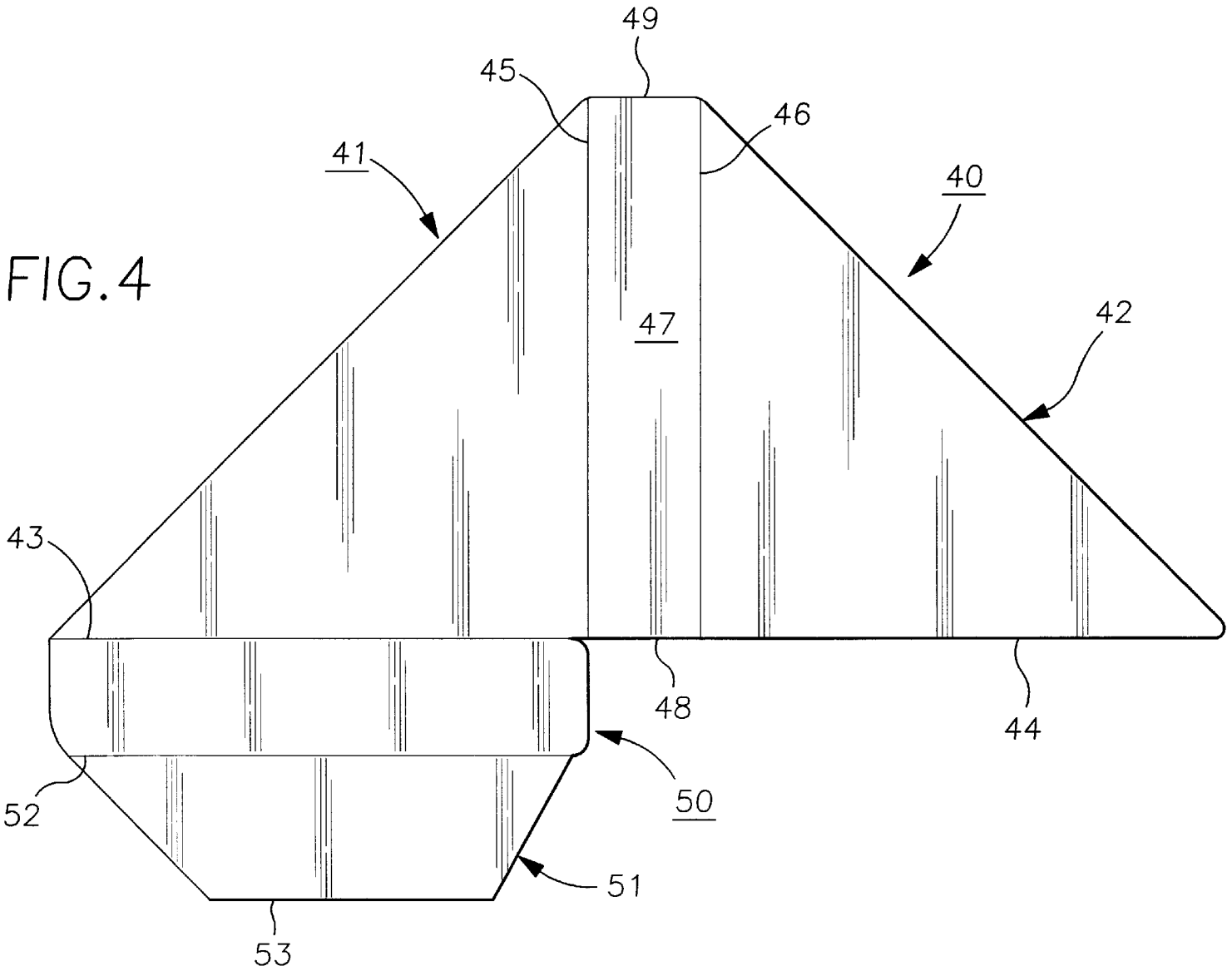
FIG. 4 is an upper plan view of a corner protector preform usable with the apparatus of FIG. 1.

The preferred embodiment of apparatus 20 according to the present invention includes a feeder mechanism 60 for automatically feeding one corner protector preform 40 at a time to a predetermined position beneath clamping bar 28 of clamping jig 23, prior to inserting a frame to be protected into the clamping jig. The structure and function of feeder mechanism 60 may be best understood by first reviewing the construction of corner protector preforms 40 used with apparatus 20. FIG. 4, shows a corner protector preform 40 of the type the apparatus 20 is intended to be used with.

As shown in FIG. 4, preform 40 is made of a thin sheet of readily bendable material, such as corrugated cardboard. Preform 40 has two laterally mirror symmetric, right-triangular shaped flaps 41 and 42, respectively. In the orientation of preform 40 shown in FIG. 4, flap 41 is on the left-hand side of the figure, and will be referred to as the left-hand flap as a matter of convenience throughout the ensuing discussion. Left and right triangular flaps 41 and 42 have collinear horizontal bases 43 and 44 joined at their respective ninety degree corner angles to opposite vertical sides 45 and 46 of a vertically elongated rectangular spine flap 47, which has a base 48 collinear with the bases of the triangles. Thus shaped, preform 40 has an appearance approximating that of an isosceles triangle having a horizontal base 43-48-44 and an upper vertex truncated by a horizontal edge 49 parallel to the base.

As shown in FIG. 4, preform 40 includes a horizontally elongated rectangularly shaped lower cover flap 50 which depends downwardly from base 43 of left-hand triangular flap 41, and has the same width as that flap. A trapezoidally-shaped securement flap 51 depends downwardly from the bottom edge wall 52 of lower rectangular cover flap 50, the securement flap having an upper edge wall coextensive with bottom edge wall 52 of the rectangular cover flap, and a lower edge wall 53 parallel to but shorter than edge wall 52.

In the preferred embodiment of corner protector preform 40, the width of spine flap 47 and the height of lower cover flap 50 are each equal to a common value which is slightly greater than the thickness of a typical picture frame, e.g., about 15/16 inch, for a frame thickness of 7/8 inch. As shown in FIG. 4, preform 40 is preferably scored along edge walls 45 and 46 of vertical spine flap 47, and along edge walls 43 and 52 of lower rectangular cover flap 50. These score lines are located along boundaries between adjacent flaps, and facilitate folding the flaps around a picture frame corner, as will be explained below.

Figure 5:
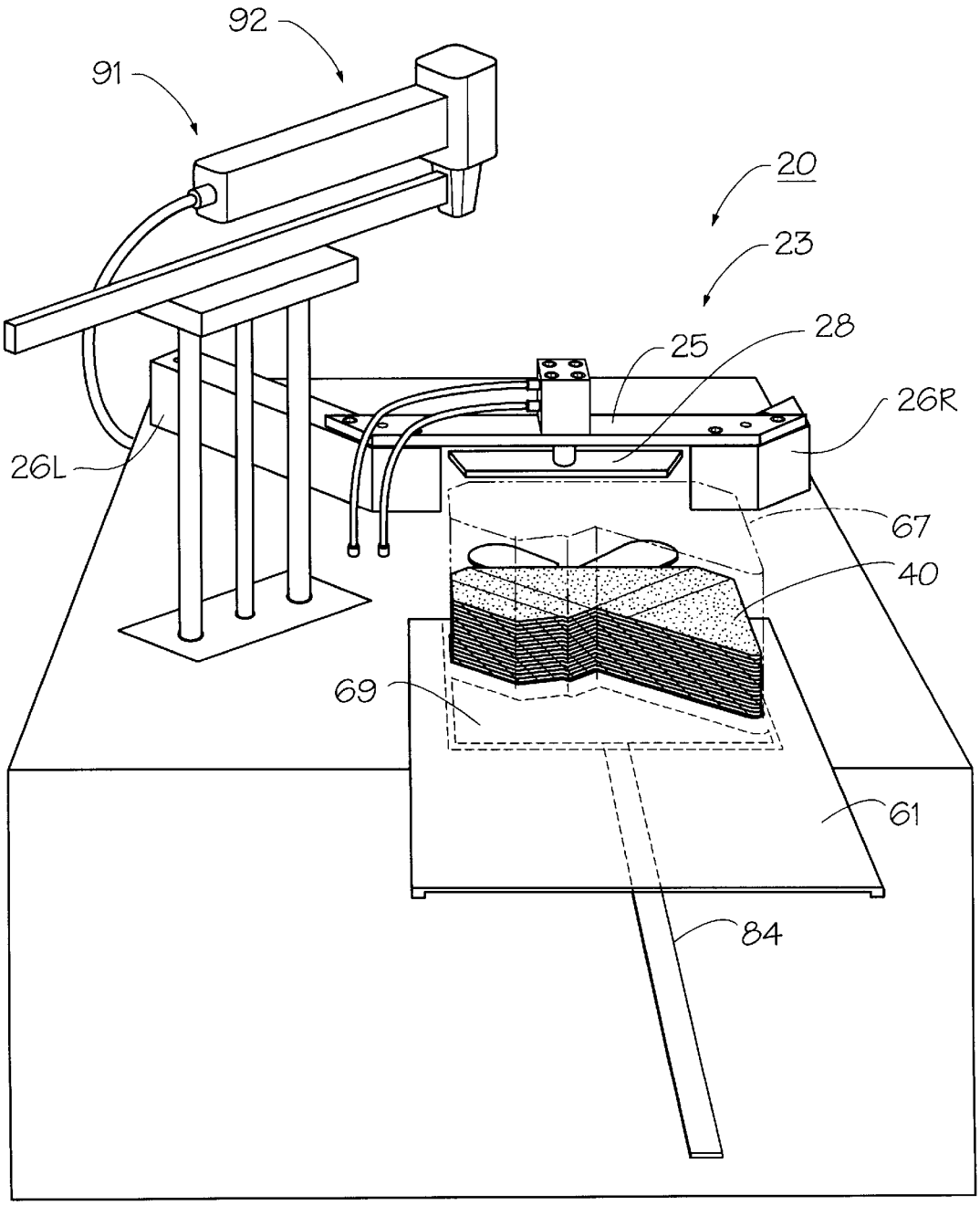
FIG. 5 is a view of the apparatus of FIG. 1, but showing a supply of corner protector preforms or blanks in a feed position on the apparatus.
Figure 18:
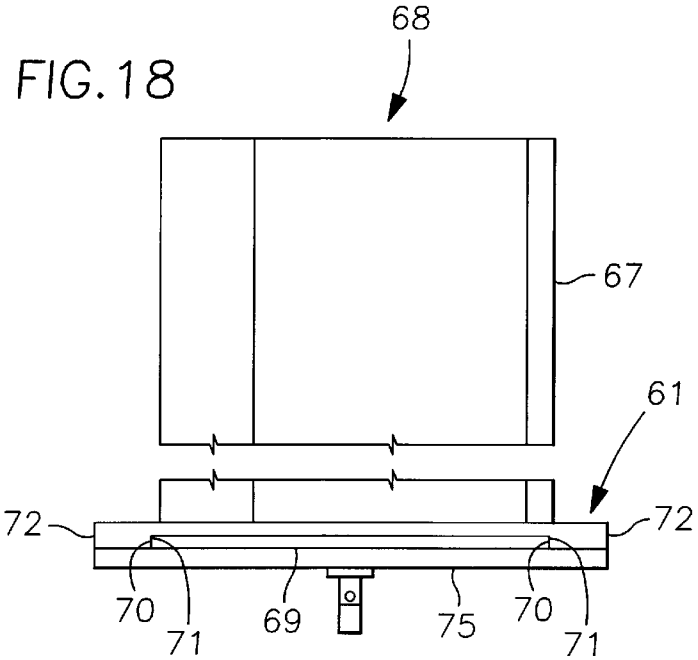
FIG. 18 is a front elevation view of the apparatus of FIG. 17.

Referring now to FIGS. 1 through 7, corner protector preform feeder mechanism 60 may be seen to include a longitudinally elongated, rectangularly shaped guide plate 61 having a generally flat upper surface mounted above and parallel to upper surface 24 of work table 22. Guide plate 61 is oriented with its long axis parallel to left and right side walls 62 and 63 of enclosure 21, and protrudes forward beyond front side wall 64 of the enclosure. As shown in FIGS. 1, 5 and 6, guide plate 61 of feeder mechanism 60 has through its thickness dimension a perforation 66 having substantially the same outline shape as corner protector preform 40. Guide plate 61 is spaced above upper surface 24 of table 22 by longitudinally disposed support ribs 72, at a distance slightly greater than the thickness of corner protector preform 40, e.g., 5/16 inch for preforms having a thickness of about 1/4 inch. Thus, a corner protector preform 40 placed conformally over perforation 66 will drop through the aperture onto work table surface 22, allowing the preform to be slid into operating position under clamping jig 23, as will be described in detail below. In the preferred embodiment, as shown in FIGS. 5 and 18, a vertically elongated tubular preform cassette 67 is releasably attached to work table 22 by machine screws. Cassette 67 has a uniform transverse cross section bore 68 which is vertically aligned with guide plate perforation 66 and which is adapted to receive a vertical stack of preforms 40.

Figure 17:
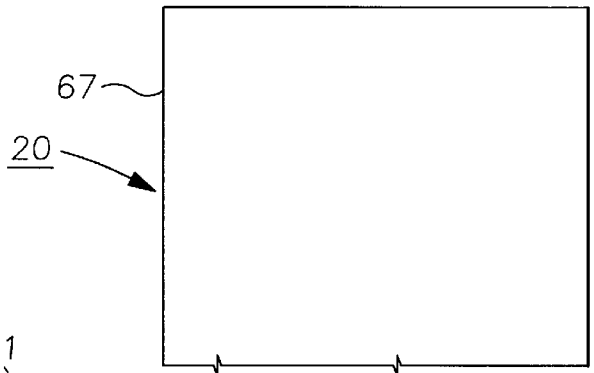
FIG. 17 is a fragmentary, partly sectional right side elevation view of the apparatus of FIG. 1, showing a corner protector blank feeder mechanism comprising part of the apparatus.
Figure 17:
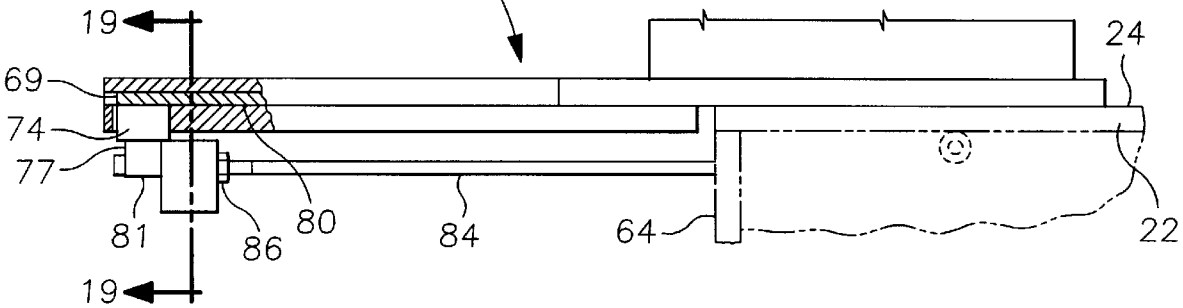

Referring now to FIGS. 1 through 7, in conjunction with FIGS. 17 and 18, feeder mechanism 60 may be seen to include a pusher plate 69 longitudinally slidably contained in longitudinally disposed guideways or grooves 70 provided in the inner facing walls 71 of guide plate support ribs 72. Pusher plate 69 has a generally uniform thickness, and has a front edge wall 73 in which is formed a groove shaped complementarity to the lower edge wall of a preform 40. Preferably, pusher plate is made of DELRIN, NYLON, or a similar structural polymer having good lubricity.

Figure 3:
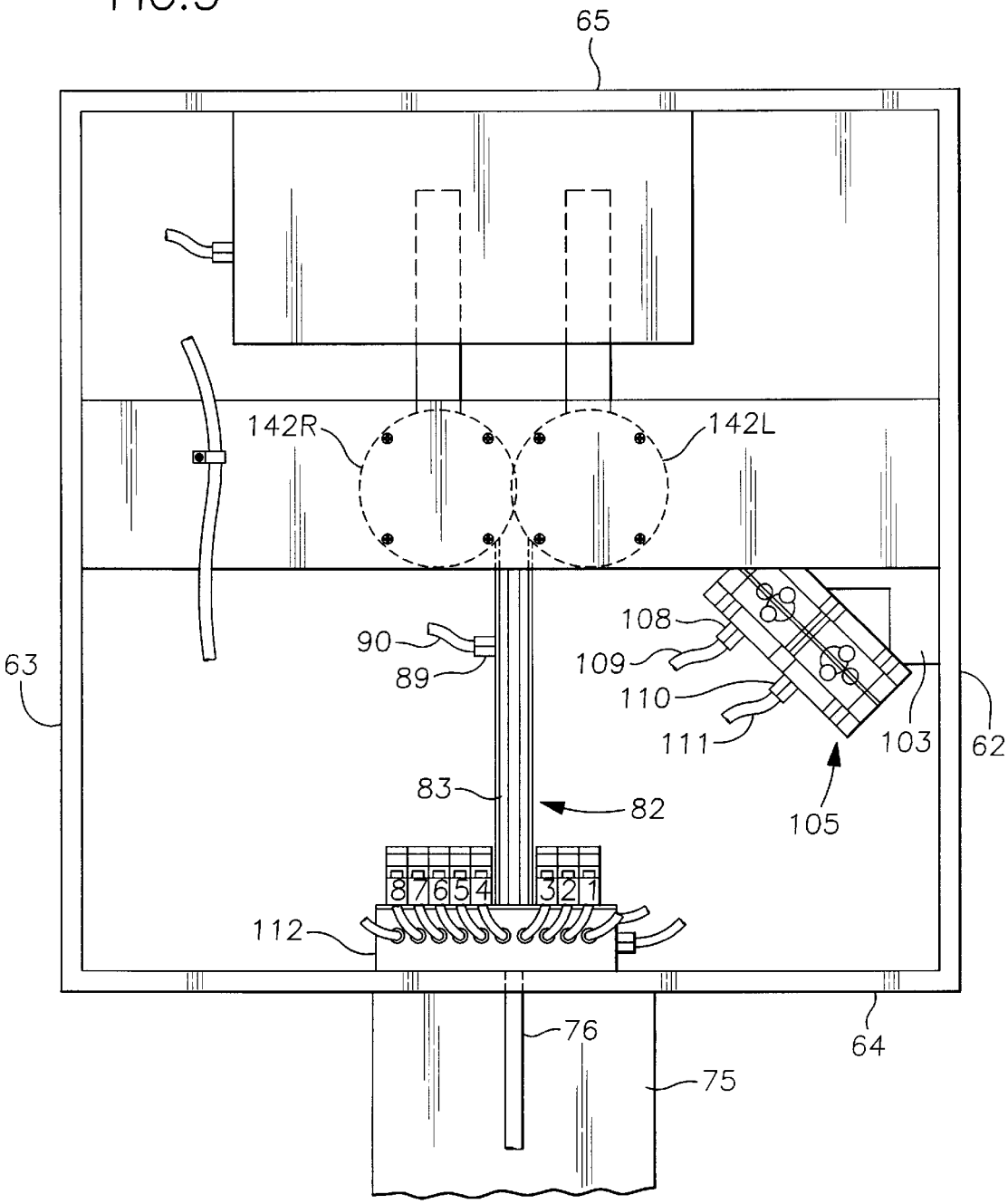
FIG. 3 is a lower plan view of the apparatus of FIG. 1.
Figure 19:
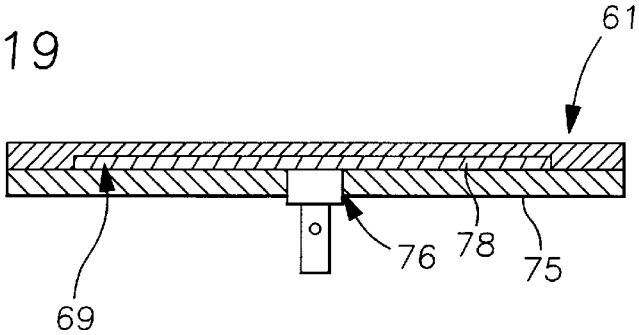
FIG. 19 is a transverse sectional view of the apparatus of FIG. 17, taken along line 19—19.

As may be seen best by referring to FIG. 3 in conjunction with FIGS. 17–19, that generally square plan view portion of guide plate 61 which protrudes forward beyond front side wall 64 of enclosure 21 has attached to its lower surface a lower cover plate 75 having the same plan view shape. Lower cover plate 75 has through its thickness dimension a longitudinally elongated rectangular perforation 76 which spans a substantial portion of the length of the lower cover plate. A bracket 77 having the approximate shape of a reversed "L" is attached to the lower surface of pusher plate 69, near its rear edge wall 78. L-bracket 77 has an upwardly protruding leg 74 that is fastened at its upper end to lower surface 80 of pusher plate 69, and which protrudes downwards through perforation 76 and is longitudinally slidable therethrough. L-bracket 77 also has a horizontally disposed leg 81 which protrudes towards front side wall 64 of enclosure 21.

Referring now to FIGS. 2 and 3, apparatus 20 may be seen to include a linear actuator mechanism including a double acting pneumatic cylinder 82 for moving feeder mechanism pusher plate 69 forwards to feed a preform 40 into position below clamp jig 23, and rearwardly to load a preform, as will be explained in further detail below.

As shown in FIGS. 2 and 3, feeder mechanism pneumatic cylinder 82 has a longitudinally disposed cylinder body 83 which is attached near the forward end thereof to a transversely disposed beam 83A located within enclosure 21 and secured to the lower surface of work table 21. Cylinder body 83 of feeder mechanism pneumatic actuator cylinder 82 has a piston rod 84 which protrudes longitudinally forward from the cylinder body through an aperture 85 through front side wall 64 of enclosure 21, the outer end 86 of the piston rod being attached to the front portion of L-bracket horizontal leg 81.

As shown in FIGS. 2 and 3, feeder mechanism pneumatic cylinder 82 has a front pressurized "feed" air inlet port 87 connected to a first, "feed" air inlet hose 88. As is also shown in those figures, cylinder 82 has a rear pressurized "retract/reload" air inlet port 89 connected to a second, "retract" air inlet hose 90. When pressurized air is supplied to "feed" air inlet port 87 of feed mechanism pneumatic cylinder 82, pressurized air on the right-hand side of a piston within the cylinder forces the piston and attached piston rod 84, to move forward relative to front wall 64 of enclosure 21. This action in turn pulls L-bracket 77 slidably forward in perforation 76, thereby pulling attached pusher plate 69 forward. As shown in FIG. 5, forward motion of pusher plate 69 advances a preform 40 into position beneath clamp bar 28 of clamping jig 23. Conversely, as shown in FIG. 6, when pressurized air is supplied to "retract/reload" air inlet port 89, pressurized air on the left side of the piston within cylinder 82 forces the piston and pusher plate 69 to a rearward position, in which another preform may drop through perforation 66 of guide plate 61 into a loaded, or pre-feed position on upper surface 24 of work table 22.

Figure 12:
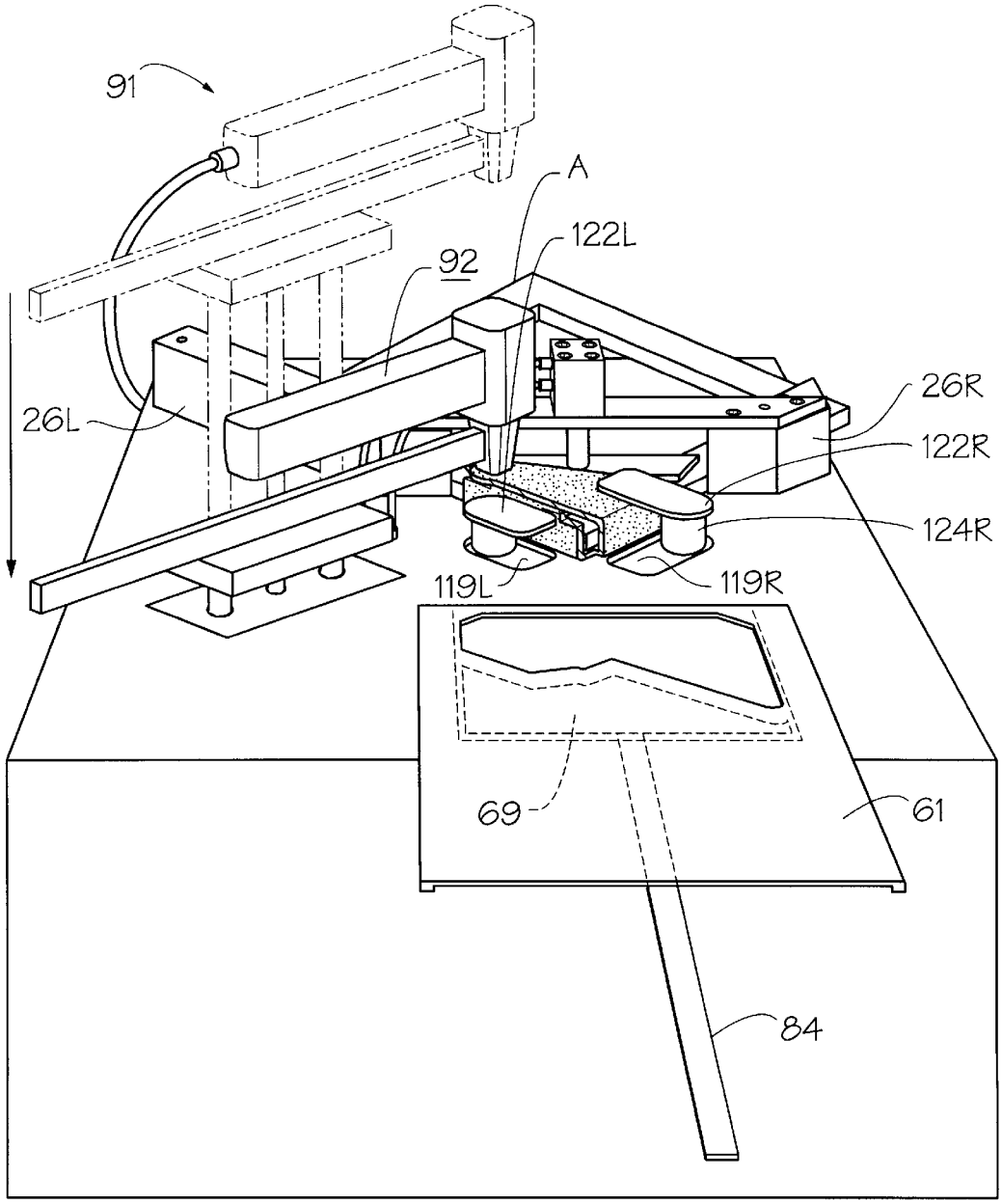
FIG. 12 is a view of the apparatus of FIG. 1 similar to that of FIG. 11, but showing the fold effecting arm of the first corner flap actuator rotated back into an inactive, home position, and showing a stapler comprising part of the apparatus inserting a staple through the second triangular cover flap and securement flap and into the picture frame.

Referring now to FIGS. 1 and 12, corner protector attachment apparatus 20 may be seen to include an automatic stapler mechanism 91 for stapling a corner protector 40 which has been folded around the corner of a picture frame. As shown in FIG. 1, stapler mechanism 91 includes a pneumatic stapler gun 92 such as a Josef Kohlberg, Model 680-6-46, which has a horizontally elongated body 93, a front vertically oriented staple inserting head 94, and a rear air inlet port 95. Stapler gun 92 has an internal pneumatic actuator mechanism (not shown) which causes a jaw 97 at the lower end of stapler gun head 94 to eject a staple forcibly outwards from the jaw into an object contacted by the jaw, when pressurized air is supplied through air supply hose 96 to air inlet port 95 of the stapler gun, manufactured by Josef Kohlberg, box 126,HJO Sweden.

As may be seen best by referring to FIGS. 1 and 12, stapler mechanism 91 includes an adjustable support structure 98 for holding and supporting at an adjustable longitudinal distance, or throat depth, jaw 97 of stapler gun 92 relative to a picture frame held in clamp jig 23.

Support structure 98 is mounted on the upper end of a compressor/elevator actuator mechanism 99 which lowers stapler gun 92 to force jaw 97 into compressive contact with a corner protector-covered picture frame corner to insert a staple therein, and raises the jaw to an upper rest position upon completion of the stapling operation.

As may be seen best by referring to FIGS. 1 and 2, compressor/elevator actuator 99 mechanism of stapler mechanism 91 includes a pair of vertically disposed, laterally spaced apart support rods 100 fastened at the upper ends thereof to the lower portion of stapler gun support structure 98. Support rods 100 are vertically slidably supported in sleeve bearings 101 located below an elongated rectangular base plate 102. Base plate 102 is fastened to a structural member 103 within enclosure 21, and is located below a similarly-shaped aperture 104 through work table 22.

Compressor/elevator actuator mechanism 99 includes a linear actuator comprising a double acting pneumatic cylinder 105 for raising and lowering stapler gun 92. Pneumatic cylinder 105 is mounted to structural member 103 which is attached to enclosure side wall 62 base plate 102, and has a piston rod 106 which protrudes vertically upwards through a bore 107 provided through base plate 102. Piston rod 106 is located midway between support rods 102, and is also fastened at its upper end to the lower portion of stapler gun support structure 98.

As shown in FIGS. 1 and 2, compressor/elevator actuator cylinder 105 has a first, upper pressurized "down" air inlet port 108 connected to a first down air inlet hose 109, and a second, lower, "up" air inlet port 110 connected to a second, "up" air inlet hose 111. Hoses 110 and 111 connect to a source of pressurized air through a solenoid valve bank 112. Valve bank 112 contains a plurality of solenoid valves individually actuable by electrical command signals received from a Programmable Logic Controller (PLC) 113, which is electrically connected to the solenoid valve bank. The operation of solenoid valve bank 112 and Programmable Logic Controller 113 will be described below.

When pressurized air is supplied to "down" air inlet port 110 of compressor/elevator cylinder 105, pressurized air on the upper side of a piston within the cylinder forces the piston, attached piston rod 106, and stapler gun 92 downwards into a lower position in which the stapler gun may eject a staple into a corner protector and pusher frame. Conversely, when pressurized air is supplied to "up" air inlet port 100, pressurized air on the lower side of the piston within cylinder 105 forces the piston and stapler gun to an upper, home position.

Referring now to FIGS. 1 and 13–16, corner protector apparatus 20 may be seen to include a pair of corner flap folder actuators 120L and 120R located on the left and right sides, respectively, of a longitudinal center line of work table 22 of the apparatus. As shown in FIG. 1, flap fold actuators 120L and 120R are located longitudinally forward of clamping jig 23, in a location that places the actuators adjacent the sides of a frame insert forward under clamp bar 28 of clamping jig 23. Flap folder actuators 120L and 120R are identical in structure and function. Therefore, in the ensuing description, the flap folder actuators will be referred to generally without a subscript.

As shown in FIGS. 1 and 13–16, each flap folder actuator 120, such as left-hand folder actuator 120L, may be seen to include a flat, rectangularly-shaped flap folder arm 121 which fits into a complementarily shaped recess 119 provided in upper surface 24 of work table 22, flush with the upper surface. Arm 121 is oriented with a long, inner longitudinal edge 122 thereof parallel and adjacent to a side of a picture frame protruding diagonally forward from beneath clamp bar 28 of clamping jig 23.

Figure 13:
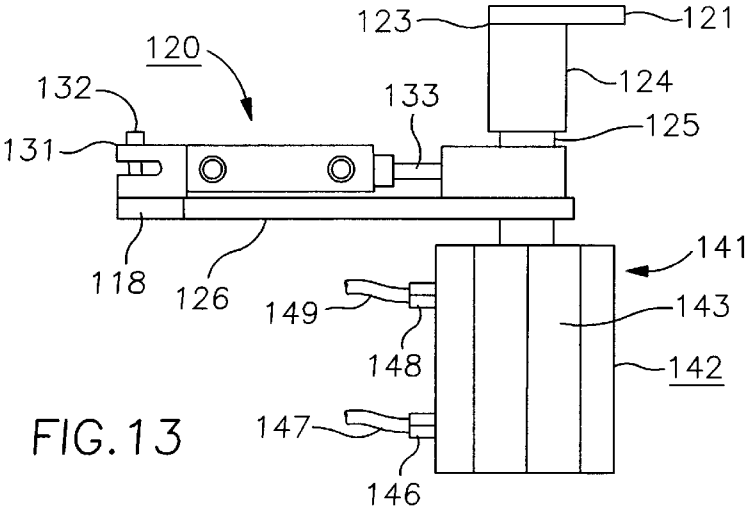
FIG. 13 is a side elevation view of a left-hand corner flap actuator comprising part of the apparatus of FIG. 1, showing the actuator in a vertically retracted, inactive position.
Figure 14:
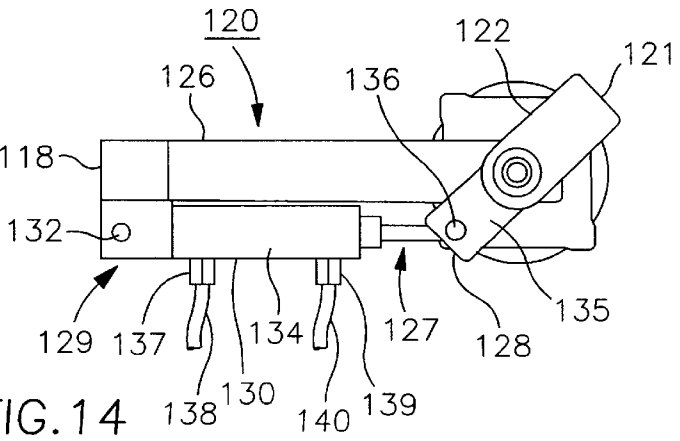
FIG. 14 is an upper elevation view of the structure of FIG. 13.
Figure 15:
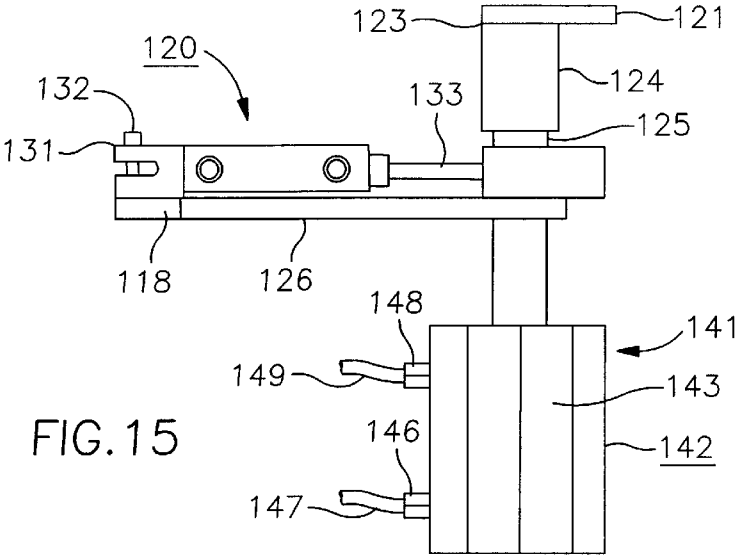
FIG. 15 is a side elevation view similar to that of FIG. 13, but showing the actuator thereof in a vertically extended position.
Figure 16:
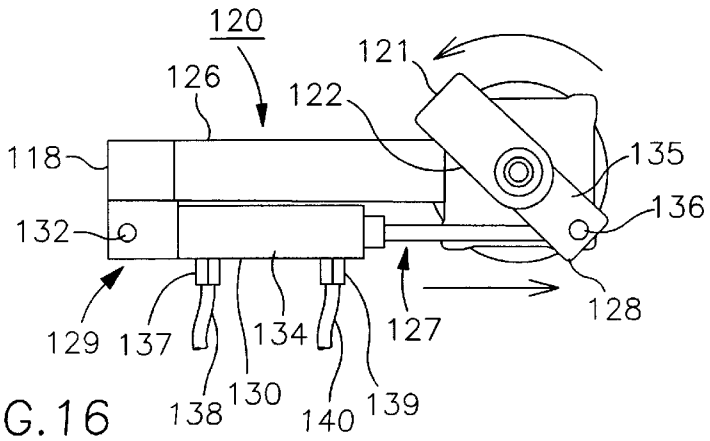
FIG. 16 is an upper elevation view of the structure of FIG. 15, showing the horizontal actuator portion of the corner flap in an extended, operating position.

As may be seen best by referring to FIGS. 13–16, flap folder arm 121 is mounted on the upper transverse end wall 123 of a vertically disposed, cylindrically-shaped support post 124. Support post 124 is in turn pivotably mounted at its lower end by a pivot bearing 125 to a horizontally elongated support frame 126. As shown in FIGS. 13 and 16, corner flap folder actuator 120 includes a rotary actuator mechanism 127 for rotating flap folder arm 121. Rotary actuator mechanism 127 includes a horizontally disposed, lower crank arm 128 which is attached to the lower end of folder arm support post 124. Lower crank arm 128 protrudes radially outwards from the lower end of cylindrical support post 126, in a direction diametrically opposed to the orientation of flap folder arm 121.

As may be seen best by referring to FIGS. 14–16, rotary actuator mechanism 127 of corner folder actuator 120 includes a linear actuator 129 comprising a double acting pneumatic cylinder 130. Pneumatic cylinder 130 has a longitudinally elongated, cylindrically-shaped body 134 and is oriented generally parallel to support frame 126, but above and offset to the side from which crank arm 128 protrudes. Pneumatic cylinder 130 is pivotably fastened at the rear end thereof by means of a rear clevis 131 and vertically disposed pivot pin 132 to a horizontally disposed lug 118 which protrudes perpendicularly outwards from the rear end of support frame 126. A piston rod 133 which protrudes forward from cylinder body 134 is pivotably fastened at the front end thereof to a clevis 135 at the outer end of crank arm 128, by a vertically disposed pivot pin 136.

As shown in FIGS. 1 and 2, rotary actuator cylinder 130 of corner flap folder actuator 120 has a first, left, "fold" air inlet port 137 connected to a first, "fold" air inlet hose 138, and a second, right, "home" air inlet port 139 connected to a second, "home" air inlet hose 140. Hoses 138 and 139 are provided with pressurized air from solenoid valve bank 112 under control of Programmable Logic Controller 113. When pressurized air is supplied to "fold" air inlet port 137, pressurized air on the left hand side of a piston within cylinder 130 causes piston rod 133 to be extended from body 134 of the cylinder, thereby causing flap folder arm 121L of left hand folder actuator 120L to rotate ninety degrees counter-clockwise, as shown in FIG. 16. Conversely, when pressurized air is supplied to "home" air inlet port 139, pressurized air on the right hand side of the piston within cylinder 130 forces the piston and piston rod 133 to retract within the cylinder thereby causing flap folder arm 121L to rotate clockwise to a home position, as shown in FIG. 14.

Referring now to FIGS. 2, 13 and 15, corner flap folder actuator 120 may be seen to include an elevator mechanism 141 for raising flap folder arm 121 from its recessed, home, position in recess 119 of work table 22, as shown in FIGS. 1 and 12, to an elevated active position, as shown in FIG. 14. Elevator mechanism 141 includes a vertically disposed linear actuator comprising a double acting pneumatic cylinder 142, for raising and lowering support frame 126. Elevator cylinder 142 has a body 143 attached at the lower end thereof to a horizontally disposed beam member 144 fastened to frame 145 of enclosure 21.

As shown in FIGS. 2, 13 and 15, elevator cylinder 142 has a first, lower "up" pressurized air inlet port 146 connected to a first "up" air inlet hose 147, and a second, upper "down" air inlet port 148 connected to a second "down" air inlet hose 149. When pressurized air is supplied to up air inlet port 146 through solenoid valve bank 112 under control of Programmable Logic Controller 113, pressurized air on the lower side of a piston within the cylinder forces the piston, attached piston rod, and support frame 126 to be elevated to an active position, as shown in FIG. 15. Conversely, when pressurized air is supplied to "down" inlet port 148 of elevator cylinder 142, pressurized air on the upper side of the piston within the cylinder lowers the piston rod and support frame 126 to an inactive, home position, as shown in FIG. 13.

OPERATION OF THE INVENTION

Programmable logic Controller (PLC) 113 gives 24 VDC command signals to pneumatic solenoid valve bank 112. In response to the command signals, the solenoids in valve bank 112 open valves which admit pressurized air into actuator cylinders, to thereby operate the cylinders. The following is the sequence of operation:

1. A vertical stack of corner protector preforms 40 is loaded into cassette 67 of feeder mechanism 60. (FIG. 5)
2. Power is turned on and PLC 113 resets and checks the system. PLC 113 is then ready for outputting sequence commands to solenoid valve bank 112. The program for the sequence is stored in a computer chip in PLC 113. This program can be changed, modified or run via a computer.
3. Actuator cylinder 82 of feeder mechanism 60 is actuated to withdraw piston rod 84, thereby moving a corrugated corner protector blank preform 40 forward into position below clamp bar 28. (FIG. 6)
4. A picture frame A is slid into position underneath clamp bar 28 and over blank 40. (FIG. 5)
5. Hold down clamp bar 28 is lowered onto frame A by cylinder #1 (30). (Motion is down). (FIG. 7)
6. The first bend of rectangular cover flap 50 and securement flap 51 as a unit, is accomplished by extending cylinder #2 (142L) upwardly. Rotatable left-hand flap folder arm 121L is in a clockwise rest position. (FIG. 8)
7. The second bend of securement flap 51 inwardly and downwardly, is effected by extending cylinder #3 (130L) outwardly, rotating right-hand flap folder arm 121R counterclockwise. (FIG. 9)
8. The third bend of right-hand triangular cover flap 42 and spine flap 47 as a unit, is effected by extending cylinder #4 (142R) upwardly. (FIG. 10)
9. The fourth and final bend of cover flap 42 inwardly and downwardly, is effected by extending cylinder #5 (130R) outwardly, rotating flap folder arm 121R clockwise. (FIG. 11)
10. At the same time cylinder #5 (130R) is extended, cylinder #3 (130L) is retracted. (FIG. 11)
11. Cylinder #6 (105) is retracted, lowering staple gun 92. Staple gun 92 has an automatic firing trigger that discharges a staple on contact with the picture frame. This action also finishes the folding process. (FIG. 12)
12. Cylinder #5 (130R) is retracted.
13. Cylinders #2 (142L) and #4 (142R) are retracted.
14. Cylinder #1 (30) is retracted, unclamping frame A.
15. Frame A is removed from clamp bar 28 by sliding the frame forward.
16. Cylinder #7 (82) is retracted and extended to load the next corner protector blank 40.
17. A new frame corner to be protected is inserted under clamp bar 28, and steps 4–14 repeated for each such corner, typically all 4 corners of a frame.

The corner protector attachment apparatus 20 described above is constructed specifically to attach corner protectors to right-angle corners of support blocks 26L and 26R of rectangularly-shaped picture frames. Thus, the dihedral angle between inner longitudinally disposed vertical side walls 228L and 228R which serve as guide surfaces for the outer side walls of a pair of picture frame side channel members which intersect at a right angle, is ninety degrees. For the same reason, the dihedral angle between inner facing, longitudinally disposed vertical side walls 122L and 122R of flap folder arms 121L and 121R is also ninety degrees. For picture frames having adjacent side channel members which intersect at an angle different from ninety degrees, apparatus 20 may be constructed with the dihedral angles between support block 26 and flap folder arms 121 both equal to that intersection angle.

What is claimed is:

1. A method for attaching a protective cover to a corner of a frame, said corner being defined by the intersection at a dihedral angle of two adjacent elongated intersecting channel members comprising two adjacent sides of said frame, said method comprising;

a. placing said frame corner over a flat corner protector pre-form comprising a thin sheet of flexible material, said sheet being foldable into a plurality of flaps including:
   (i) a vertically elongated rectangular spine flap having a width approximately equal to the thickness of said intersecting channel members,
   (ii) a first generally right triangularly-shaped, lower cover flap having a vertical side coextensive with a first vertical longitudinal side edge wall of said spine flap, a base collinear and coextensive with the lower horizontal lateral base edge wall of said spine flap, and a hypotenuse which intersects the upper horizontal lateral edge wall of said spine flap,
   (iii) a horizontally elongated, rectangularly-shaped side cover flap depending downwardly from said base of said first, lower cover flap, said side cover flap having a height approximately equal to the thickness of said intersecting channel members of said frame,
   (iv) a horizontally elongated securement flap depending downwardly from said side cover flap,
   (v) a second, generally right triangularly-shaped, upper cover flap shaped similarly to said first,lower cover flap and joined to a second vertical longitudinal side edge wall of said spine flap in a laterally opposed location to said first lower cover flap, the hypotenuse of said second, upper cover flap being inclined to said hypotenuse of said first, lower cover flap at an angle substantially equal to said dihedral angle between said adjacent intersecting channel members of said frame, b. folding upwards from the plane of said first, lower cover flap of said corner protector preform said first side cover flap and said securement flap adjacent a side wall of said first channel member, c. folding said securement flap perpendicularly inwards from said first side cover flap to overlie an upper wall surface of said first channel member, d. folding upwards from the plane of said corner protector preform said spine flap and said second, upper cover flap adjacent a side wall of said second channel member.

e. folding said second, upper cover flap perpendicularly inwards along said junction line between said second longitudinal edge wall of said spine flap and said upper cover flap to overlie said securement flap and an upper wall surface of said second channel member, and f. fastening said upper cover flap to said securement flap.

2. The method of claim 1 wherein the upper surface of said corner protector preform which is located at said first longitudinal side edge of said spine flap of said corner protector preform coextensive with said side of said first, lower triangular cover flap is further defined as being scored to facilitate folding of said, lower first triangular cover flap relative to said spine flap.

3. The method of claim 2 wherein the upper surface of said corner protector preform on which is located said second longitudinal side edge wall of said spine flap of said corner protector is further defined as being scored to facilitate folding of said second, upper triangular cover flap relative to said spine flap.

4. The method of claim 3 wherein the upper surface of said corner protector preform on which is located the intersection between said first, lower triangular cover flap and said first side cover flap is further defined as being scored to facilitate folding of said side cover flap relative to said first, lower triangular cover flap.

5. The method of claim 4 wherein the upper surface of said corner protector preform on which is located the intersection between said securement flap and said side cover flap is further defined as being scored to facilitate folding of said securement flap relative to said side cover flap.

6. The method of claim 1 wherein said angle between the hypotenuses of said first and second triangular cover flaps is further defined as being substantially a right angle.

7. An apparatus for attaching a protective cover to a corner of a frame, said frame having adjacent elongated channel members which form side walls of said frame and which intersect at a dihedral angle to form a corner of said frame, said protective cover being made from a preform made of a thin sheet of flexible material, said apparatus comprising;

a. means for bending upwardly from said preform a first side cover portion adjacent to a side of a first of said intersecting channel members, b. means for bending inwardly from said first side cover portion a securement portion which overlies an upper side wall of said first one of said frame channel members, c. means for bending upwardly from said preform a second side cover portion adjacent to a side of said second intersecting channel member, d. means for bending inwardly from said second side cover portion a second cover flap portion which overlies said securement portion, and e. means for securing said preform to said frame.

8. The apparatus of claim 7 wherein said means for bending adjacent a side wall of a first one of said pair of adjacent channel members a first side cover portion of said preform is further defined as being a first flap folder arm attached to first end of a first vertically upwardly movable linear actuator, said arm being located in a first recess in the upper surface of a worktable, below said preform, whereby upward extensional motion of said first linear actuator forces said first portion of said preform to bend upwardly from said worktable surface.

9. The apparatus of claim 8 wherein said means for bending perpendicularly inwardly from said first side cover portion of said preform a securement portion overlying said frame channel member is further defined as being first rotary actuator means coupled to said first flap folder arm, said first rotary actuator means being effective in rotating said first flap folder arm from an elevated position vertically aligned with said first arm recess to a position overlying said first channel member, thereby bending over from said first side cover portion a securement flap.

10. The apparatus of claim 9 wherein said means for bending adjacent a side wall of a second one of said pair of adjacent channel members a second side cover portion of said preform comprising a spine portion and a second triangular cover flap portion is further defined as being a second flap folder arm attached to a first, upper end of a second vertically upwardly movable linear actuator, said arm being located in a second recess in said upper surface of said worktable, below said preform,whereby upward extensional motion of said second linear actuator forces said second side portion of said preform to bend upwardly from said worktable surface.

11. The apparatus of claim 10 wherein said means for bending said second triangularly-shaped upper cover flap perpendicularly inwards from said spine flap is further defined as being second rotary actuator means coupled to said second flap folder arm, said second rotary actuator means being effective in rotating said second flap folder arm from an elevated position vertically aligned with said second arm recess to a position overlying said channel member.

12. An apparatus for folding a corner protector preform around the corner of a frame, said corner being defined by the intersection at a dihedral angle of two adjacent elongated intersecting channel members comprising two adjacent sides of said frame, said corner protector preform comprising a thin sheet of flexible material foldable into a plurality of flaps including;

(i) a vertically elongated rectangular spine flap having a width approximately equal to the thickness of said intersecting channel members, (ii) a first generally right triangularly-shaped, lower face cover flap having a vertical side coextensive with a first vertical longitudinal side edge wall of said spine flap, a base collinear and coextensive with the lower lateral base edge wall of said spine flap, and a hypotenuse which intersects the upper horizontal lateral edge wall of said spine flap, (iii) a horizontally elongated, rectangularly-shaped side cover flap which depends downwardly from said base of said first lower face cover flap, said side cover flap having a height approximately equal to the thickness of said intersecting channel members of said frame, and depending downwardly from said side cover flap, (iv) a horizontally elongated securement flap depending downwardly from said side cover flap, (v) a second, generally right triangularly-shaped upper face cover flap shaped similarly to said lower face cover flap and joined to a second vertical longitudinal side edge wall of said spine flap in a laterally opposed location to said lower face cover flap, the hypotenuse of said upper face cover flap being inclined to said hypotenuse of said lower face cover flap at an angle substantially equal to said dihedral angle between said adjacent intersecting channel members of said frame, said apparatus comprising;

a. support means for supporting said preform and a corner of said frame overlying said lower cover flap of said preform, b. means for bending upwardly and adjacent to a first intersecting side channel member of said frame from the plane of said preform and said lower face cover flap, said side cover flap and said securement flap, c. means for bending inwardly from said side cover flap said securement flap d. means for bending upwardly and adjacent to said second intersecting channel member of said frame from the plane of said preform and said lower face cover flap said spine flap and said upper face cover flap, e. means for bending inwardly from said spine flap said upper face cover flap to a location overlying said second channel member of said frame and said securement flap, and f. means for securing said preform in said folded disposition to said frame.

13. The apparatus of claim 12 further including means for releasably securing said frame to said supporting means of said apparatus.

14. The apparatus of claim 13 wherein said means for releasably securing said frame to said supporting means of said apparatus is further defined as being a clamping bar.

15. The apparatus of claim 14 wherein said clamping bar is further defined as being perpendicularly actuable relative to said support means.

16. The apparatus of claim 12 further including guide means for slidably receiving and holding said frame in a fixed horizontal disposition relative to said support means.

17. The apparatus of claim 16 wherein said guide means is further defined as comprising in combination a pair of elongated blocks disposed obliquely to one another and having inner facing obliquely disposed wall surfaces inclined relative to one another at said dihedral angle of said frame, said blocks having between converging longitudinal ends thereof a laterally disposed space adapted to insertably receive said corner of said frame.

18. The apparatus of claim 12 wherein said support means is further defined as being a tabular body having a generally flat upper work surface.

19. The apparatus of claim 18 wherein said means for bending said first, lower face cover flap and said securement flap from the plane of said lower face cover flap is further defined as comprising in combination a first flap folder arm having a flat wall surface disposed parallel to and spaced outwardly apart from said first frame channel member, and first linear actuator means for elevating said first flap folder arm vertically upwardly from a first recessed portion of said tabular body, flush with said upper work surface.

20. The apparatus of claim 19 wherein said means for bending said securement flap inwardly from said side cover flap section is further defined as first rotary actuator means coupled to said first linear actuator means, said first rotary actuator means being effective in rotating said inner wall of said first flap folder arm inwardly towards said first frame channel member.

21. The apparatus of claim 20 wherein said means for bending said spine flap and said upper face cover flap of said preform is further defined as comprising in combination a second flap folder arm having a flat inner wall surface disposed parallel to and spaced outwardly apart from said second frame channel member and second linear actuator means for elevating said second flap folder arm vertically upwardly from a second recessed portion of said tabular body, flush with said upper work surface.

22. The apparatus of claim 21 wherein said means for bending said second upper face cover flap from said spine flap is further defined as second rotary actuator means coupled to said second linear actuator means, said second rotary actuator means being effective in rotating said inner wall of said second flap folder arm inwardly towards said second frame channel member.

23. The apparatus of claim 22 wherein said means for securing said preform in said folded over disposition relative to said frame corner is further defined as comprising a staple gun vertically actuable relative to said work table surface.

* * * * *